US007594880B2

(12) United States Patent
Webber et al.

(10) Patent No.: US 7,594,880 B2
(45) **Date of Patent: *Sep. 29, 2009**

(54) SELF-ALIGNING PIVOTING SEAT EXERCISE MACHINE

(75) Inventors: Randall T. Webber, La Jolla, CA (US); Christopher E. Brennan, Santee, CA (US); Bruce Hockridge, San Diego, CA (US); Jeffrey O. Meredith, San Diego, CA (US)

(73) Assignee: Hoist Fitness Systems, Inc., San Diego, CA (US)

( * ) Notice: Subject to any disclaimer, the term of this patent is extended or adjusted under 35 U.S.C. 154(b) by 867 days.

This patent is subject to a terminal disclaimer.

(21) Appl. No.: 10/633,805

(22) Filed: Aug. 4, 2003

(65) Prior Publication Data

US 2005/0032611 A1 Feb. 10, 2005

(51) Int. Cl.
*A63B 21/00* (2006.01)

(52) U.S. Cl. ..... 482/96; 482/95

(58) Field of Classification Search ..... 482/95, 482/96, 140, 72, 137, 142
See application file for complete search history.

(56) References Cited

U.S. PATENT DOCUMENTS

| | | | |
|---|---|---|---|
| 248,121 | A | 10/1881 | Tuttle |
| 2,481,121 | A | 10/1881 | Tuttle |
| 2,252,156 | A | 8/1941 | Bell |
| 3,446,503 | A | 5/1969 | Lawton |
| 3,592,465 | A | 7/1971 | Fulkerson, Jr. |
| 3,640,528 | A | 2/1972 | Proctor |
| 3,707,285 | A | 12/1972 | Martin |
| 4,111,414 | A | 9/1978 | Roberts |
| 4,231,568 | A | 11/1980 | Riley et al. |
| 4,300,760 | A | 11/1981 | Bobroff |
| 4,632,390 | A | 12/1986 | Richey |
| 4,700,946 | A | 10/1987 | Breunig |
| 4,743,010 | A | 5/1988 | Geraci |
| 4,793,608 | A | 12/1988 | Mahnke et al. |
| 4,844,456 | A | 7/1989 | Habing et al. |
| 4,949,951 | A | 8/1990 | Deola |

(Continued)

OTHER PUBLICATIONS

Boss Fitness Brochure, 1993.

(Continued)

*Primary Examiner*—Jerome Donnelly
(74) *Attorney, Agent, or Firm*—Procopio, Cory, Hargreaves & Savitch LLP

(57) ABSTRACT

An exercise machine has a main frame with a pivot mount, a user support frame pivotally mounted on the pivot mount, the pivot mount defining a vertical, gravitational center line, an exercise arm movably mounted for engagement by the user in performing exercises, a connecting link linking movement of the exercise arm to movement of the user support frame, and a load for resisting movement of at least one of the moving parts. Movement of the user engagement device in an exercise movement simultaneously moves the user support frame between a start and an end position, the pivot mount being positioned at a predetermined location under the user support frame, such that portions of the combined weight of the user and user support frame are distributed on each side of the gravitational centerline throughout the entire exercise movement and only a portion of the combined weight passes through the gravitational centerline during the exercise movement.

27 Claims, 19 Drawing Sheets

U.S. PATENT DOCUMENTS 4,949,958 A 8/1990 Richey
5,100,128 A 3/1992 Mabry
5,106,081 A 4/1992 Webb
5,108,095 A 4/1992 Nichols
5,250,013 A 10/1993 Brangi
5,263,914 A 11/1993 Simonson et al.
5,267,930 A 12/1993 Henes
5,299,997 A 4/1994 Chen
5,330,405 A 7/1994 Habing et al.
5,334,120 A 8/1994 Rasmussen
5,342,269 A 8/1994 Huang et al.
5,346,447 A 9/1994 Stearns
5,352,171 A * 10/1994 Lin ..... 482/96
5,356,357 A 10/1994 Wang et al.
5,356,358 A * 10/1994 Chen ..... 482/96
5,421,796 A 6/1995 Jones et al.
5,437,589 A 8/1995 Habing
5,447,480 A 9/1995 Fulks
5,453,066 A 9/1995 Richter, Jr.
5,458,553 A 10/1995 Wu
5,499,959 A 3/1996 Holmes et al.
5,503,608 A 4/1996 Chang
5,507,710 A 4/1996 Chen
5,527,249 A 6/1996 Harris
5,540,639 A 7/1996 Potts et al.
5,549,530 A 8/1996 Fulks
5,554,086 A 9/1996 Habing et al.
5,562,577 A 10/1996 Nichols et al.
5,573,482 A 11/1996 Wang et al.
5,580,340 A * 12/1996 Yu ..... 482/96
5,580,341 A 12/1996 Simonson
5,603,678 A 2/1997 Wilson
5,643,147 A 7/1997 Huang
5,643,152 A 7/1997 Simonson
5,658,227 A 8/1997 Stearns
5,669,865 A 9/1997 Gordon
5,672,142 A 9/1997 Wu
5,674,161 A 10/1997 Lin
5,676,626 A 10/1997 Huang
5,695,434 A 12/1997 Dalebout et al.
5,702,328 A 12/1997 Mansvelt
5,722,918 A 3/1998 Lee
5,733,229 A 3/1998 Dalebout et al.
5,733,232 A 3/1998 Hsu
5,749,813 A 5/1998 Domzalski
5,803,882 A 9/1998 Habing et al.
5,810,701 A 9/1998 Ellis et al.
5,827,158 A 10/1998 Drecksel
5,876,095 A 3/1999 Johnston
5,961,427 A 10/1999 Habing et al.
5,967,954 A 10/1999 Habing
5,997,446 A 12/1999 Stearns
6,071,216 A 6/2000 Giannelli et al.
6,074,328 A 6/2000 Johnson
6,080,091 A 6/2000 Habing et al.
6,086,521 A 7/2000 Solland
6,244,995 B1 6/2001 Prsala
6,251,047 B1 6/2001 Stearns et al.
6,264,588 B1 7/2001 Ellis
6,302,832 B1 10/2001 Stearns
6,387,020 B1 5/2002 Simonson
6,394,937 B1 5/2002 Voris
6,491,609 B2 12/2002 Webber
6,605,024 B2 8/2003 Stearns
6,916,278 B2 7/2005 Webber
6,966,872 B2 11/2005 Eschenbach
6,971,978 B2 12/2005 Hyder
7,052,444 B2 5/2006 Webber
2002/0103058 A1 8/2002 Webber
2005/0096196 A1 5/2005 Webber et al.
2005/0096197 A1 5/2005 Webber et al.
2005/0096198 A1 5/2005 Webber et al.

OTHER PUBLICATIONS

Hammer Strength, Hammer Brochure, 1993.
FS-403 Shoulder Press, Flex Brochure, 1995.
Paramount Advanced Performance System—Leg Press Ap—2800 (brochure dated 2000).
08003 Rower, Gym 80 Brochure, 2001.
Gym 80 Brochure, 2001.
Leg Press, Cybex International Brochure, 2002.
Gravity Gym Instruction Manual, date unknown.
Flex Fitness Brochure, date unknown.
Spirit Circuit, Hogan Industries Brochure, date unknown.
Pace, Henley International Brochure, date unknown.
FA-508 Dip Machine, Flex Brochure, date unknown.
Spirit Hogan Industries Brochure, date unknown.
Models 217 and 206-2, Polaris Brochure (date unknown).
Schwinn Natural Strength, Schwinn Magazine advertisement, date unknown.
U.S. Appl. No. 11/846,437, filed Aug. 28, 2007, Webber, et al.
U.S. Appl. No. 11/849,028, filed Aug. 31, 2007, Webber, et al.
U.S. Appl. No. 11/848,012, filed Aug. 30, 2007, Webber, et al.
U.S. Appl. No. 11/846,459, filed Aug. 28, 2007, Webber, et al.
U.S. Appl. No. 11/846,472, filed Aug. 28, 2007, Webber, et al.
FL-103 Hamtractor, FL-104 Hamflexor, Flex Fitness Brochure, 2002.
Leg Extension, Nautilus Brochure, date unknown.

* cited by examiner

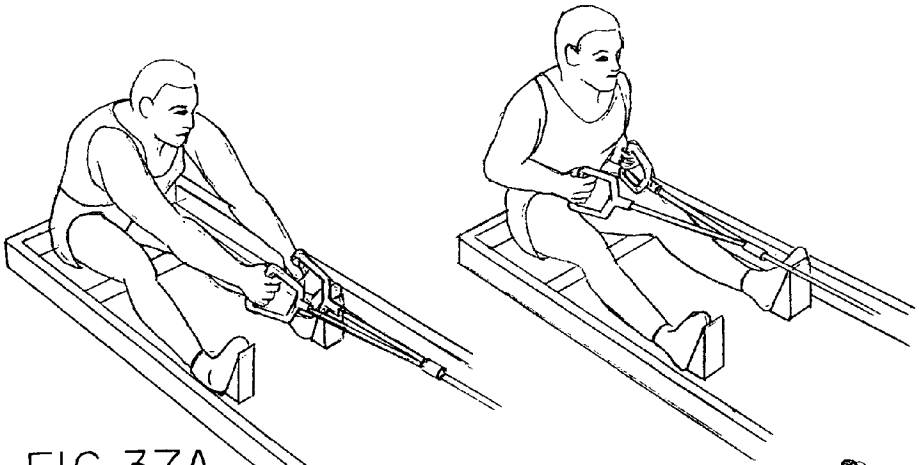
FIG. 37A
FIG. 37B
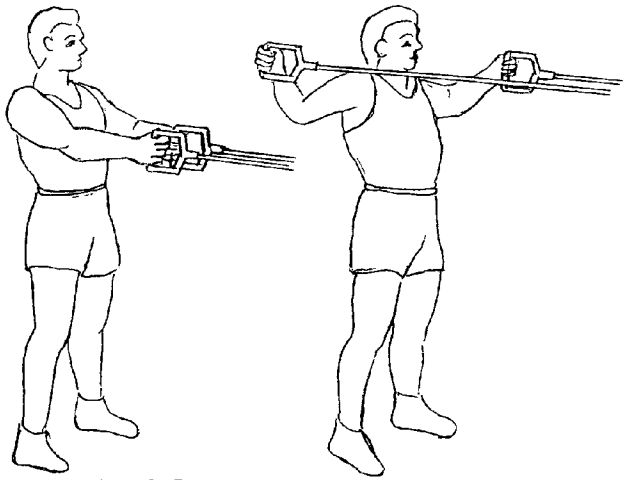
FIG. 40A
FIG. 40B
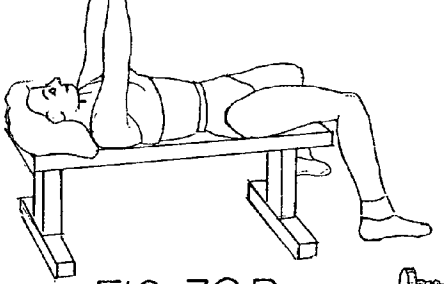
FIG. 39B
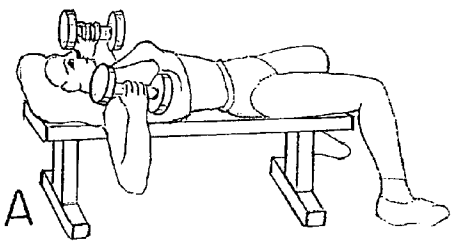
FIG. 39A
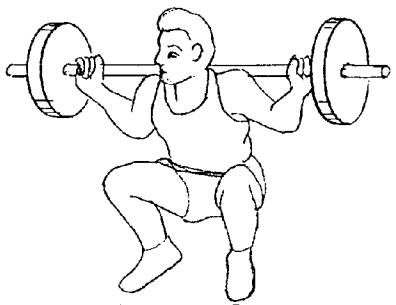
FIG. 38A
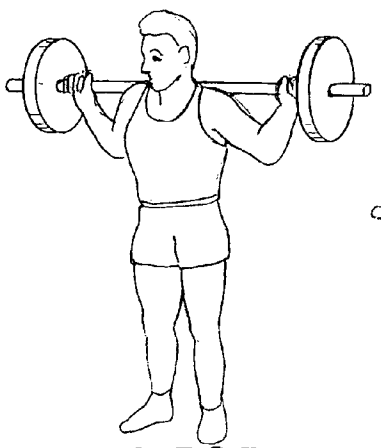
FIG. 38B

SELF-ALIGNING PIVOTING SEAT EXERCISE MACHINE

BACKGROUND OF THE INVENTION

This invention relates generally to exercise machines, and is particularly concerned with compound movement exercise machines which have a pivoting user support.

There are two basic types of exercise movements, isolation and compound. Isolation movements are designed to isolate a specific muscle or muscle group and to reduce body part movement to involve rotation of a single joint. Leg extensions and biceps curls are examples of isolation movements. Compound movement exercises involve more than one body part and require multiple joint action. Because of this, they exercise a greater number of muscles/muscle groups. There is also a difference in the travel path for the two types of movement. Isolation movements tend to be rotational with concentric travel paths, while compound movements tend to be curvilinear, with elliptical travel paths.

Compound movements are a natural and fundamental form of exercise and show up in everything from professional athletics to everyday activities. Jumping, rowing, swimming, and throwing all involve multi-joint movements. Squats, bench presses, chin-ups, bar dips, shoulder presses, and the like, are all compound movement exercises. While fundamental in everyday life, they can be difficult for many people to perform as exercises, requiring balance and coordination as well as strength to follow the proper movement path. Improper form by the exerciser can make the exercise more difficult, increase stress on the joints, and even lead to possible injury.

Various exercise machines have been developed for performing compound movement exercises involving various muscles and muscle groups. Some of these have a stationary user support, while others have a pivoting or movable user support, which may or may not be linked to the exercise arm or user engagement means. One problem in most or all prior art designs is the unnatural and exaggerated arcing movement found in pivoting arm exercise machines, which do not accurately simulate the natural body movement found in free weight and/or free bar exercises.

Movable user supports linked to the movement of an exercise arm are extremely common in exercise machines, and are generally known as composite motion exercise machines. U.S. Pat. No. 2,252,156 of Bell and U.S. Pat. No. 6,251,047 of Stearns show bicycle and exercise bike designs in which a seat or user support is linked to an exercise arm or crank and pedal system to provide up and down movement to the seat. The most common application of movable user supports is found in rowing and horse riding type exercise machines, which use the weight of the user as the exercise resistance. In U.S. Pat. No. 3,446,503 of Lawton, U.S. Pat. No. 4,743,010 of Geraci, and U.S. Pat. No. 5,342,269 of Huang, a seat and exercise arm are pivotally mounted on the base frame, with the seat linked to the exercise arm for dependent movement. U.S. Pat. No. 4,300,760 of Bobroff, U.S. Pat. No. 5,299,997 of Chen, U.S. Pat. No. 5,356,357 of Wang, U.S. Pat. No. 5,453,066 of Richter, U.S. Pat. No. 5,458,553 of Wu, U.S. Pat. No. 5,503,608 of Chang and U.S. Pat. No. 5,507,710 of Chen all show horse riding type exercise machines. They all consist of a user support pivotally attached to a base frame, and one or more exercise arms pivotally connected to the frame and pivotally linked to the user support.

U.S. Pat. No. 6,264,588 of Ellis shows a composite motion movement machine that has a moving exercise arm linked to a movable user support, and a pivoting truck system which is slidably connected to rails mounted both on the main frame and user support. The movable user support and exercise arm are both pivoted at the same point on the base frame, in front of the user support. A belt connects the exercise arm to the truck. When the exercise arm is pushed or pulled, the belt pulls the truck along the rails, forcing the user support to rotate about its pivotal connection to the frame. This design puts all of the user's weight on one side of the pivot, producing a high initial lifting resistance when the user starts the exercise, and also has no means for properly aligning the exercise arm and user support during the exercise movement.

Movable seats linked to exercise arms have also been used in multi-purpose exercise machines, such as U.S. Pat. No. 5,330,405 of Habing, U.S. Pat. No. 5,334,120 of Rasmussen, U.S. Pat. No. 5,669,865 of Gordon, U.S. Pat. No. 5,733,232 of Hsu, and U.S. Pat. No. 6,244,995 of Prsala. In U.S. Pat. No. 5,330,405 of Habing, a lever arm is pivotally connected to the base frame and supports a movable sub-frame including a user support which is also pivotally connected to the stationary base frame. An exercise arm is pivotally mounted on the sub-frame and linked to the lever arm via cables and pulleys, so that movement of the exercise arm pulls the cables lifting the lever arm, and causing the sub-frame to pivot about its connection to the base frame and rise against the weight of the user. U.S. Pat. No. 5,733,232 of Hsu shows another multi-purpose exercise machine with a pivoting seat, but in this case the back pad is stationary and only the seat pad is pivoted. Thus, the seat travels in an arcuate path without any secondary stabilization for the user, forcing the user to try to maintain their balance on the seat as it arcs upward. Also, in this design, the pivot point for the seat is located at a spacing behind the user position, so that all of the user's weight will oppose the user when starting an exercise from rest. Neither of these machines has any capability for aligning the user and user support with a rigid exercise arm, and thus do not maintain or support the user in the proper position throughout the exercise.

Gordon shows a multi-purpose exercise machine that has a hinged, two-piece user support that folds and unfolds with each exercise repetition. The user support consists of a seat portion and a backrest portion, which are pivotally connected together. The user support is pivotally connected to a main frame, as is a first exercise arm. This first exercise arm provides pressing and pulldown exercises. A second exercise arm is pivotally connected to the user support for providing leg exercises. This second arm travels with the seat portion of the user support. A connecting link pivotally connects the first exercise arm with the user support so that movement in the arm forces movement in the user support. The link connects to the user support at the same pivot that joins the seat portion with the backrest portion. In a second embodiment a flexible line connects the user support with the main frame and has user-engaging handles attached to one end so that movement to the handles results in movement to the user support. In this design, the flexible line acts as both connecting link and exercise arm. In both designs, the seat and backrest do not travel in a fixed relationship to each other and additional support such a footrest, safety belts and thigh gripping surfaces are required to keep the user properly and safely positioned in the user support. Because most of the combined weight of the user and user support remain on one side of the user support's gravitational centerline, this weight is used as partial exercise resistance. Movement of the user support is designed to be an exercise of its own, rather than providing proper positioning/alignment of the user relative to the exercise arm. The folding and unfolding of the two-piece user support constantly works the abdominal and low back muscles, which means that these muscles are being worked even when other exercises are being performed. The user cannot truly isolate any one specific muscle or muscle group. The stomach cannot be worked without working the low back, the arms, chest, shoulders, upper back and legs all must be worked with one another or at the least with both the stomach and low back. Because of this the user cannot fully fatigue other muscles as the abdominals and low back would fatigue first.

A squat exercise apparatus is described in both U.S. Pat. No. 5,108,095 of Nichols and U.S. Pat. No. 5,603,678 of Wilson. In Nichols, a four bar linkage system is used to keep the user support (back pad and shoulder pads) vertical while it is being moved along an arcuate exercise path. This design requires a belt around the user's waist to keep them in the proper position, and is awkward to use. The entire weight of the moving carriage is positioned on one side of the pivotal connection to the main frame, creating an initial starting weight or resistance which may be too heavy for most users, and requires addition of a counter balance to offset the carriage weight. This in turn poses a hazard to anyone standing next to, or walking past, the moving part. Wilson has a generally T-shaped user support frame rotatably mounted on the base of the stationary frame. A back pad, handgrips, and resistance receiving means are all attached to the pivoting user support frame. The user pushes against a fixed foot plate in order to pivot the backrest. There is no secondary user support to properly position the user, and improper positioning could result in serious injury.

Various exercise machines are also known which allow users to perform chin up and/or bar dip exercises. Some examples of these machines are described in U.S. Pat. No. 3,592,465 of Fulkerson, U.S. Pat. No. 3,707,285 of Martin, U.S. Pat. No. 4,111,414 of Roberts, U.S. Pat. No. 5,011,139 of Towley, U.S. Pat. No. 5,322,489 of Webb, U.S. Pat. No. 5,449,959 of Holmes, and U.S. Pat. No. 5,540,639 of Potts. In these machines, the user sits or stands on a movable user support, and pushes or pulls with their hands in order to raise their body, assisted by the counter-balanced user support. While the user support moves in these designs, it is not urged to do so by movement of an exercise arm. The only user engaging means or handles are stationary and fixed to the main frame. A further disadvantage of these machines is the limitation of the handle or user gripping position, which may put the hand and/or wrist of the user in an uncomfortable position at some point in the movement, causing undue strain which may lead to injury. U.S. Pat. No. 248,121 of Tuttle and U.S. Pat. No. 5,876,095 of Johnston describe exercise machines for performing dips in which a movable user support or platform is linked to an exercise arm, so that movement of the exercise arm forces movement of the user support. Both of these designs have the user support traveling upward in a generally vertical direction while the user support remains horizontal, and both place the exerciser's wrist in an awkward starting position. Neither of these designs describes or suggests orienting or aligning the position of the user support to the position of the exercise arm or user engaging means.

Current exercise machines for performing compound or multi-joint exercises, whether using composite motion or a fixed user support, do not accurately maintain proper positioning of the user throughout the exercise motion, can result in awkward hand or wrist positions, and often involve exaggerated and unnatural arcing movements, or linear, non-arcing arm movements, rather than the smaller elliptical movement associated with free weight or natural exercise movements. There is no provision for proper positioning of the user relative to the position of the user engaging portion of the exercise arm throughout the entire exercise motion. Often, an awkward starting or finishing position is required, causing strain and potential injury.

SUMMARY OF THE INVENTION

It is an object of the present invention to provide a new and improved compound movement exercise machine which provides multi-joint exercise movement.

According to the present invention, a compound movement exercise machine is provided, which comprises a main frame, a user support pivot mount on the main frame defining a vertical, gravitational center line of the pivotal movement, a user support frame pivotally mounted on the user support pivot mount, a primary user support pad mounted on the user support frame, an exercise arm movably mounted on one of the frames and having at least one user engagement portion for engagement by the user in performing exercises, a connecting link linking movement of the exercise arm to movement of the user support frame, and a load for resisting movement of at least one of the moving parts of the machine, whereby movement of the exercise arm in an exercise movement simultaneously moves the user support frame between a start position and an end position, the user support pivot mount being positioned such that the combined weight of the user and user support frame is distributed on each side of the gravitational centerline of the pivot in both the start and end position and only a portion of the combined weight passes through the gravitational centerline during the exercise movement, and a major portion of the weight of the user and user support does not remain on one side only of the gravitational centerline over the entire exercise movement.

With this exercise machine, a portion of the combined weight of the user and user support frame is positioned on the movement side (i.e. the side the user support is pivoting towards) of the gravitational center line of the pivot in the start position. This reduces the initial lifting resistance. By finishing the exercise with a portion of the combined user and user support weight on the trailing side of the center line in the movement direction, resistance "drop-off" at the end of an exercise is minimized. This balanced distribution reduces the effect of the user's body weight on the resistance felt during the exercise. This is the opposite of most exercise devices that have moving user supports, which tend to rely on the weight of the user for resistance. Whether it is the starting or the finishing position, most prior art pivoting user supports place the majority of the user's weight on one or the other side of the pivoting mechanism's gravitational center line. Thus, prior art exercise machines with pivoting user supports will have either a high initial lifting resistance, or else a resistance "drop off" at the end of the exercise.

The user support frame in an exemplary embodiment has both a primary user support, such as a seat pad or back pad, and a secondary user support, such as a back pad, shoulder pad, thigh hold-down pads, chest pad, or the like. It may also have a supplementary stabilization means such as a foot rest or hand grip, which is suitably mounted on, and traveling with, the user support frame. This provides additional stabilization to the user, helping them to maintain a proper exercise position and providing additional comfort and support. The use of multiple support pads on the user support frame helps to position the exerciser properly and safely. These supports are in fixed alignment to each other and travel together, keeping the user in the same braced position throughout the entire exercise range of motion. This allows the user to focus on the exercise rather than worrying about their positioning on a moving platform or seat.

The exercise arm or user engagement means is movably mounted on the main frame, the user support frame, or the connecting link. The connecting link links movement of the exercise arm to movement of the user support, and is movably engaged with at least two of the main frame, exercise arm, and user support. In one example, the user support and exercise arm are both moveably mounted on the frame, and the connecting link is directly connected between them. In another arrangement, the exercise arm may be pivotally mounted on the user support while the connecting link extends between the exercise arm and frame, such that movement of the exercise arm will force the user support to pivot. The user support frame may be pivoted on the base of the main frame so that it is relatively low to the ground and readily accessible to the user in entering and exiting the machine.

The exercise arm may be a one piece member or two piece for independent arm movement, and may be unidirectional or bi-directional. It may be arranged to be pushed or pulled in performing exercises, and may be rigid or flexible. The connecting link may be rigid or flexible, and may be adjustable in length or position. The user engagement portion of the exercise arm may be one or two handles or footpads. If handles are provided, they may be rigid or flexible, fixed or self-aligning, and may provide two dimensional or three dimensional hand movement. The exercise resistance or load may comprise a weight stack, weight plates mounted on pegs, or other types of resistance such as hydraulic, pneumatic, electro-magnetic, or elastic bands, and may be associated with any of the moving parts, i.e. the user support frame, exercise arm, or connecting link.

The pivoting user support automatically aligns with the movement of the exercise arm, to provide proper positioning for the user relative to the user engaging portion of the exercise arm throughout the entire exercise movement. This provides a safer, more natural exercise movement that makes the exerciser want to exercise. By controlling the position of the user support, this design corrects the unnatural movement found in the exaggerated arc of pivoting arms and the non-arcing movement of linear exercise arms, replacing them with a smaller, more natural elliptical movement associated with free weight or body weight exercises.

The compound exercise machine of this invention provides a safer, easier to use, more comfortable exercise that more accurately mimics the natural movement and body alignment found in free weight and body weight (bar) exercises. The multiple user support pads provide secure and safe positioning, placing the user in the proper exercise position from start to finish. The combined exercise arm and user support movement produces an automatic and continuous self-aligning exercise motion that allows enhanced hand, wrist or foot position as compared to similar exercises provided on prior art machines. The user support pivot is positioned so that a portion of the combined weight of the user and user support is always positioned on each side of the gravitational center line of the pivot in both the start and finish positions and throughout the exercise motion. This provides counter balancing, preventing exercise resistance drop-off and offsetting the weight of the exercise arm, with limited effect on the exercise resistance felt by the user. The machine automatically produces the proper starting and finishing arm/hand positioning for a user when handles are the user engagement devices on the exercise arm, because the user support automatically adjusts to the exercise arm position.

BRIEF DESCRIPTION OF THE DRAWINGS

The present invention will be better understood from the following detailed description of an exemplary embodiment of the invention, taken in conjunction with the accompanying drawings in which like reference numerals refer to like parts and in which:

FIGS. 37*a* and 37*b* are schematic views illustrating an exerciser performing a rowing type exercise, which is an exercise duplicated by the mid-row exercise machine of FIGS. 17 to 20;

FIGS. 38*a* and 38*b* are schematic views illustrating an exerciser performing a free weight standing squat exercise, which is an exercise duplicated by the lying leg press exercise machine of FIGS. 21 to 24;

FIGS. 39*a* and 39*b* are schematic views illustrating an exerciser performing a free weight fly type exercise using dumbbells, which is an exercise duplicated by the pec fly exercise machine of FIGS. 25 to 28; and FIGS. 40*a* and 40*b* are schematic views illustrating an exerciser performing a rear deltoid exercise, which is an exercise similar to the exercise performed on the rear deltoid exercise machine of FIGS. 29 to 33.

DETAILED DESCRIPTION OF THE DRAWINGS

The drawings illustrate a number of different exercise machines according to different embodiments of the present invention, designed for performing different types of compound or multi-joint exercises. Each machine is designed to provide a pivoting user support which automatically aligns with movement of an exercise arm and which provides proper positioning of the user throughout the entire exercise movement.

Figure 34B:
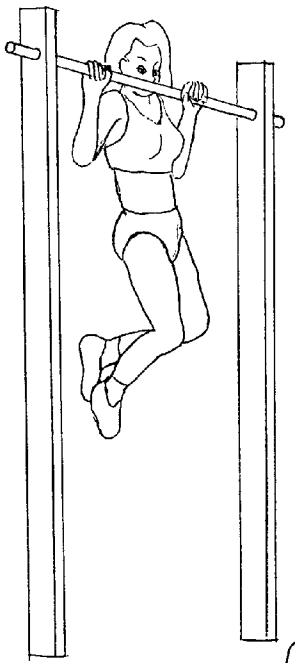
FIGS. 34*a* and 34*b* are schematic views illustrating an exerciser performing a free weight chin up exercise using an overhead chinning bar, which is an exercise duplicated by the rigid arm pull down exercise machine of FIGS. 1 to 4.
Figure 34A:
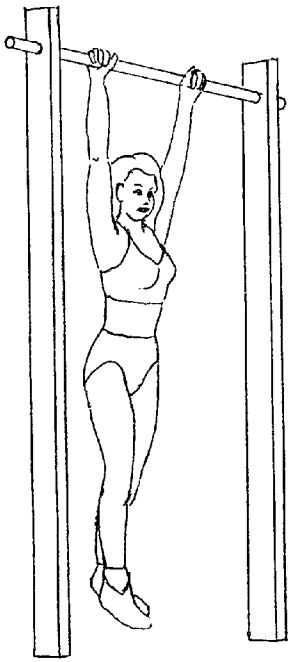

FIGS. 1 to 4 illustrate a rigid arm pull down machine 10 which allows a user to perform chin up type exercises similar to the free body weight exercise performed by a user pulling themselves up from the ground while gripping an overhead bar or "chinning" bar, with the user raising their body until their chin touches the bar. The exercise carried out with the machine 10 accurately mimics the natural body alignment in the start and finish positions of a free body weight chin up exercise, which is illustrated in FIGS. 34*a* and 34*b*, as will be explained in more detail below.

The machine 10 comprises a main frame having a horizontal base section 12 and an upright section 14, a generally T-shaped user support frame 15 pivotally mounted on the base section via pivot mount 16, and an exercise arm 18 pivotally mounted at the top of the upright section 14 of the frame. The upright section 14 of the frame includes a vertical housing 20 containing a weight stack (not visible in the drawings), and a slightly forwardly inclined upright strut 22. A horizontal strut 24 extends between the top of housing 20 and the upright strut 22.

The exercise arm 18 comprises a generally U-shaped member 25 with a rearwardly projecting arm 26 extending from the mid-point of the U-shaped member and pivoted to the upper end of strut 22 via pivot 28 at a mid point in its length. The rear end of arm 26 is linked to the weight stack 21 via a cable 30 extending from anchor 32 on the horizontal strut 24, over a pulley 33 at the end of arm 26, then back around pulley 34 on strut 24 and via additional pulleys (not visible in the drawings) to the top of the weight stack. A U-shaped handle bar 35 is pivoted at pivot 36 to the forward ends of the U-shaped member 25 so as to be suspended downwardly from bar 25 for gripping by a user.

An adjustable length connecting link 38 pivotally connects the exercise arm 18 to the user support frame 15. The link 38 has a first end pivoted to the rear portion 26 of the exercise arm at pivot 40, and a second end pivoted to the user support frame 15 at pivot 42. The link 38 comprises two telescopically engaging parts which are secured together at a selected extension via a spring loaded pull pin 44 engaging in a selected opening 45 in one of the telescoping parts.

The user support frame 15 is generally T-shaped, having a base member 46 and an upright member 48 projecting upwardly from the central region of member 46. A seat pad or primary support 50 is mounted at the forward end of base member 46, in front of upright member 48, and a foot rest or stabilization means 52 is mounted at the rear end of member 46. The connecting link pivot 42 is provided on a pivot bracket 54 adjacent foot rest 52. A secondary user support is provided at the upper end of upright member 48, and comprises a pair of roller pads 55 on a strut 56 telescopically mounted in member 48. The position of the roller pads 55 can be adjusted by moving strut 56 up or down and then securing it in position via a spring loaded pull pin 58.

The user support frame is pivotally mounted on base 12 via a four bar linkage system comprising the base strut 46 of the user support, the pivot mount 16, and a pair of lever arms 60,62. The first lever arm 60 is pivoted at one end to the forward end of pivot mount 16 via pivot 64, and to the forward end of base strut 46 at the opposite end, via pivot 65. The second lever arm 62 is pivoted at one end to the rear end of the pivot mount 16 via pivot 66, and at the opposite end to the rear end of the base strut 46 via pivot 68.

Figure 2:
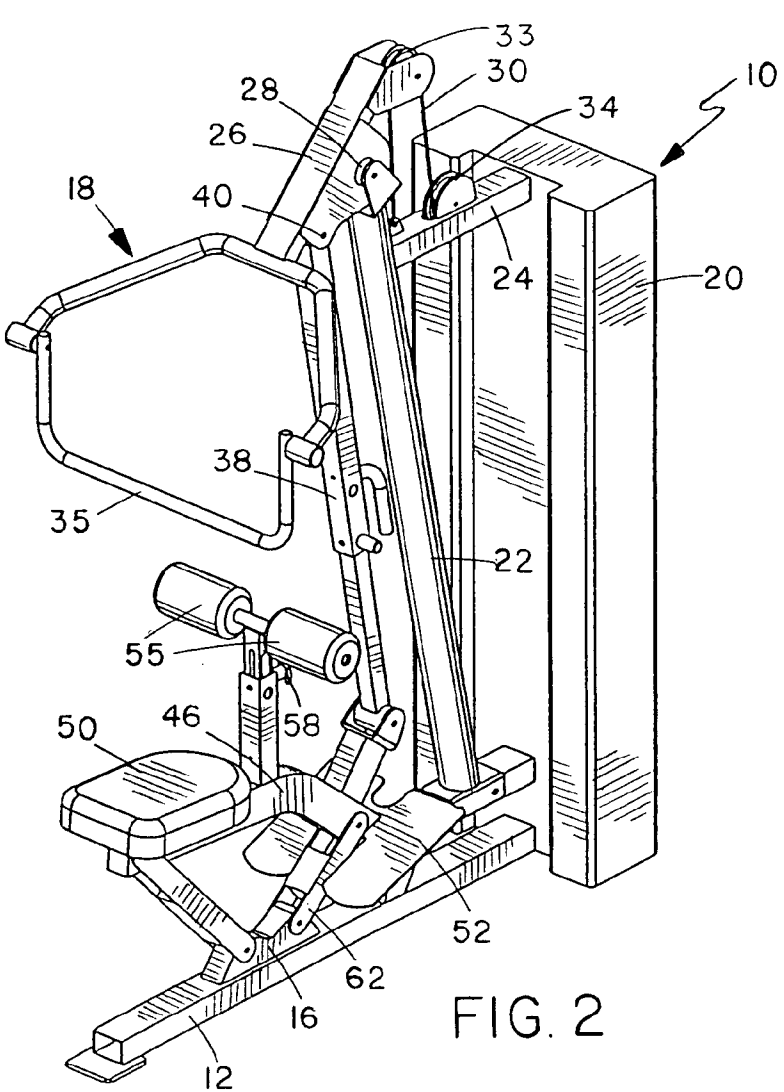
FIG. 2 is a perspective view similar to FIG. 1, illustrating the machine in an exercise ending position.
Figure 1:
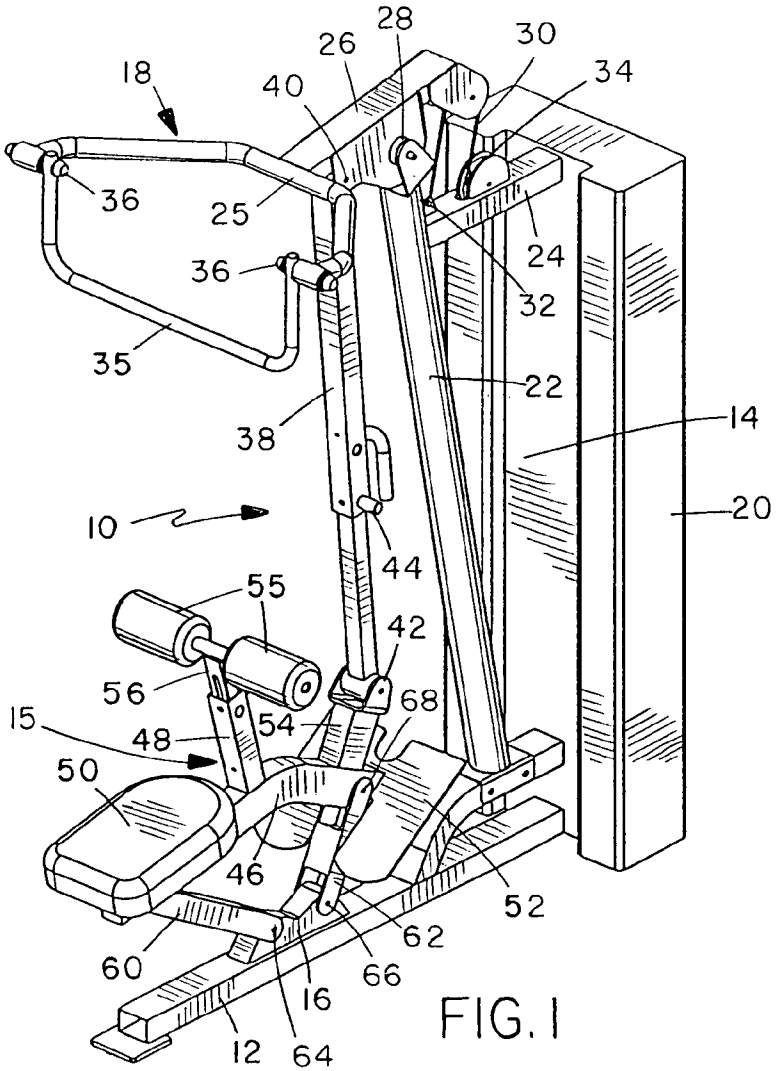
FIG. 1 is a front perspective view of a compound motion exercise machine according to a first embodiment of the invention for performing a rigid arm pull down exercise, with the machine illustrated in a start position adopted at the beginning of an exercise movement.
Figure 4:
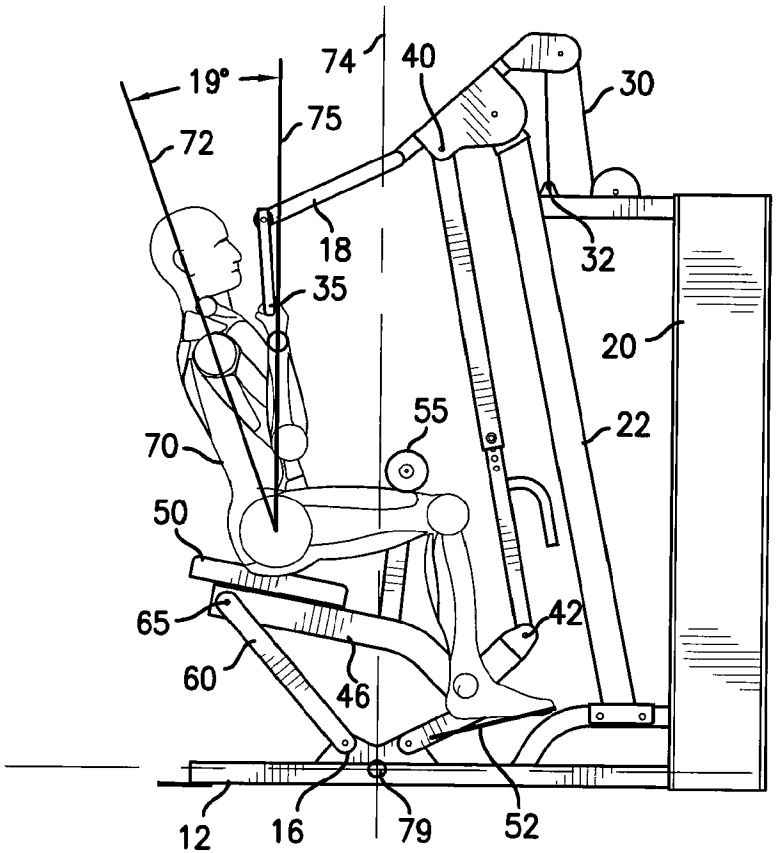
FIG. 4 is a side elevation view similar to FIG. 3, illustrating the exerciser's body position at the end of the pull down exercise.
Figure 3:
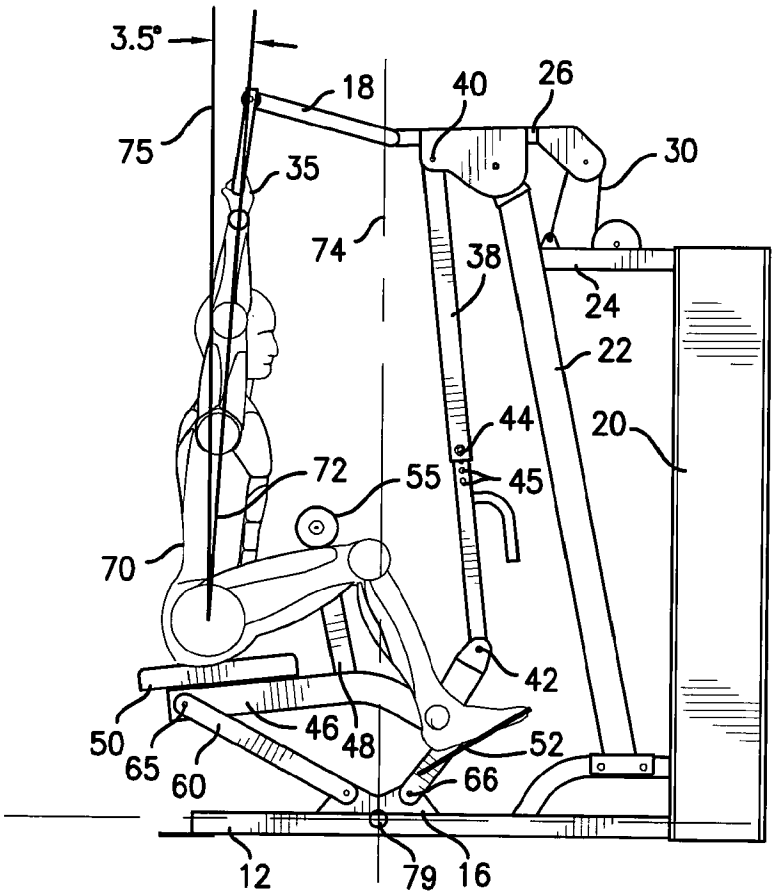
FIG. 3 is a side elevation view of the machine of FIGS. 1 and 2, illustrating an exerciser's body position at the start of the exercise.

FIG. 1 illustrates the start position of the rigid arm pull down machine without an exerciser, while FIG. 2 illustrates the finish position. FIGS. 3 and 4 illustrate the same positions with the user 70 in place to perform a chin up exercise. To perform the exercise, the user positions themself in a seated position on seat pad 50, which will start in a slightly downwardly reclined orientation as illustrated in FIG. 3. They then slide their legs under the thigh hold down roller pads 55, adjusting the position of these pads by sliding the strut 56 up and down if necessary, and place their feet on the user support footrest or plate 52. They then grab the handle bar 35 of the exercise arm 18 and pull it downwards. The starting position of FIG. 3 places the user's upper body in a slightly forward lean with their arms extending straight overhead, in line with the side center line 72 of their body. If necessary, the user can adjust the distance between the user support seat 50 and exercise arm bar or handle 35 by adjusting the length of connecting link 38.

As the exercise arm 18 moves downwards, rotating about the pivots 28 and 40, the connecting link 38 pushes the rear end of the user support frame 15 downwards, rotating the frame about the four bar linkage into the finish position illustrated in FIG. 4, in which the seat pad 50 is moved into an upwardly inclined orientation. At the same time, the selected weights in the weight stack are lifted via the cable and pulley linkage between the rear end of the exercise arm and the weight stack. As the seat pad changes its orientation from a reclined angle to an inclined angle, the user will automatically adjust their upper body position rearward (relative to their angular position on the seat) to compensate for this change in seat angle, and will finish the exercise with their hands below their chin and slightly in front of their shoulders. This slight rearward movement mimics the natural rearward arc a person's upper body goes through when performing a free bar chin up, as illustrated in FIGS. 34*a* and 34*b*. By comparing the body position of the exerciser in FIG. 34*a* with that of FIG. 3, and the position of FIG. 34*b* with that of FIG. 4, it can be seen that the exercise machine closely mimics the natural body alignment of an exerciser in both the start and finish positions when performing body weight exercises on a chinning bar. This provides the user with a safer and more comfortable compound exercise movement than was possible with previous rigid arm pull down exercise machines.

It can be seen that the user support pivot is positioned under the user support frame such that a substantial portion of the combined weight of the user and the support frame is positioned on each side of the gravitational center line 74 of the pivot in both the start and finish positions. Since the pivot is a four bar linkage in the embodiment of FIGS. 1 to 4, the user support frame pivots about a theoretical pivot axis 79 which is the effective pivot point for the combined pivotal movement of the four bar linkage, and the gravitational center line is a theoretical center line which passes through the theoretical pivot axis of the pivotal movement. The portion of both the user and the user support positioned on each side of line 74 varies only very slightly from the start to the finish point of the exercise movement. This balanced distribution minimizes the effect that the combined weight of the user and user support has on the exercise resistance, while still allowing it to act as a counter balance to offset the weight of the exercise arm. The combined weight of the user and support will have little effect on the amount of starting resistance, because a substantially equal amount of weight is balanced rearward of the user support pivot. By the same token, because only a small portion of the user passes through the gravitational center line 74 during the exercise, there is no appreciable drop-off in resistance felt by the user.

The line 75 in FIGS. 3 and 4 represents the perpendicular or vertical centerline of the user in both the start and finish positions, while line 72 is the side centerline. As illustrated in FIG. 3, at the start of the exercise, the user is in a forward lean of approximately 3.5 degrees off vertical, with their arms fully extended and in line with the body side centerline. At the end of the exercise, as illustrated in FIG. 4, the user is reclining at approximately 19 degrees to the vertical centerline 75, with their hands positioned under the chin and slightly forward of their shoulders. Thus, the upper body moves through an angle of approximately 22.5 degrees, as it will when performing a free chin up exercise with an overhead chinning bar, as in FIGS. 34*a* and 34*b*. The pull down exercise machine 10 therefore closely mimics the natural movement and body alignment found in a free bar chin up exercise.

Another advantage of this machine is the multiple user supports. The primary user support in this case is the seat pad 50, while a secondary support is provided by the thigh hold-down pads 55. A further support or stabilization means is provided by the foot pads 52 which travel with the user support frame 15. The multiple user supports help to provide proper positioning of the user relative to the user engaging portion of the exercise arm throughout the entire exercise movement. This also makes the apparatus much more comfortable and natural for the user, making the user want to exercise. The foot pads keep the user's feet in the same relaxed and supported position throughout the entire exercise movement.

The rigid arm pull down machine 10 places the user's body in a slightly forward lean at the start of the exercise, to compensate for the reclined angle of the seat, with their arms extended straight overhead and in line with their body side centerline. The body orientation changes to a reclined angle mimicking the natural rearward arc the body goes through when performing a chin up exercise, with the user finishing the exercise with their arms under their chin.

FIGS. 5 to 8 illustrate another type of exercise machine which incorporates the same unique features in order to better mimic a corresponding free bar exercise, and to properly support the user throughout the exercise movement while ensuring that no major change in weight distribution occurs during the exercise movement. The machine 80 of FIGS. 5 to 8 is a seated dip exercise machine for performing an exercise which is equivalent to a free bar dip exercise.

The machine 80 has a main frame comprising a horizontal base 82, a rearwardly and upwardly inclined upright strut 84, a pivot mount 85 extending upwardly from the base 82, and an upright weight stack housing 86 at the forward end of base 82. The housing contains a conventional selectorized weight stack. A generally L-shaped user support frame 88 is pivotally mounted at the upper end of pivot mount 85 via pivot 89. The user support frame 88 has a first or base portion 90 on which a seat pad 92 is mounted, and a second or upright portion 94 on which a back pad 95 is mounted. The pivot 89 is located on the base portion 90 beneath seat pad 92. The forward end of base portion 90 is linked to the weight stack or exercise resistance via a cable and pulley linkage 96, part of which is visible in the drawings. In this embodiment a foot rest or footplate 97 is mounted on the base 82 of the frame, rather than on the user support frame, at a position in front of the forward end of the base portion 90, such that a user can easily rest their feet on the footplate when seated on the seat pad 92.

Figure 5:
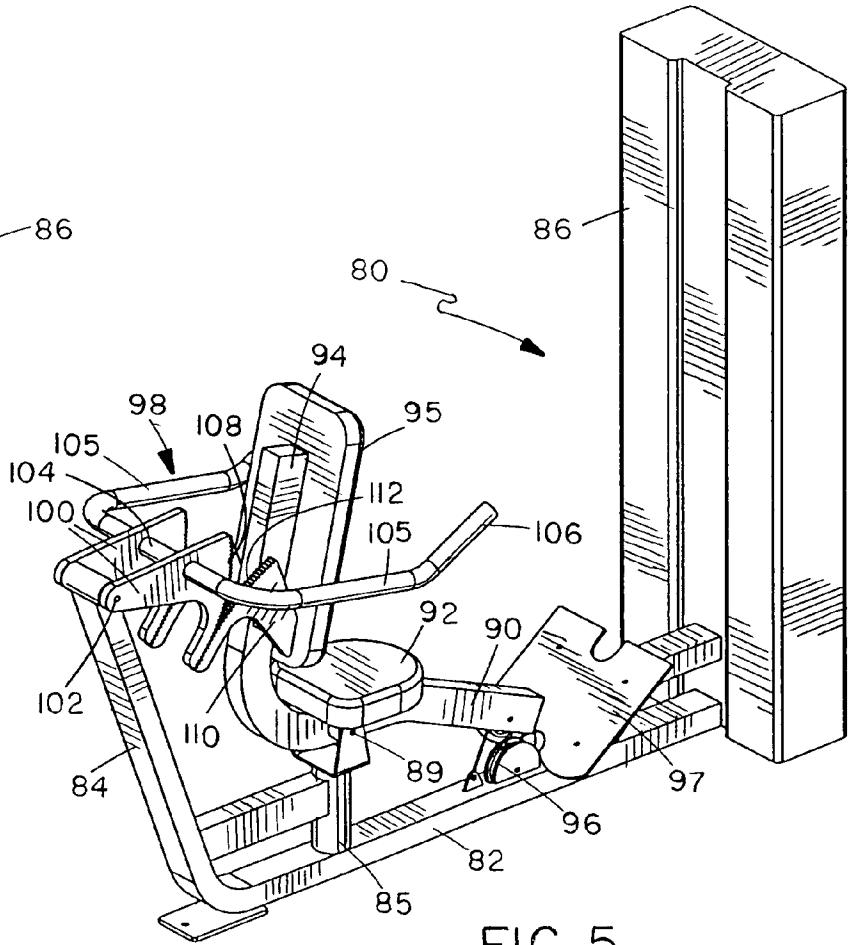
FIG. 5 is a rear perspective view of a seated dip exercise machine according to a second embodiment of the invention for performing bar dip type exercises, with the machine illustrated in the exercise start position at the start of an exercise movement.
Figure 6:
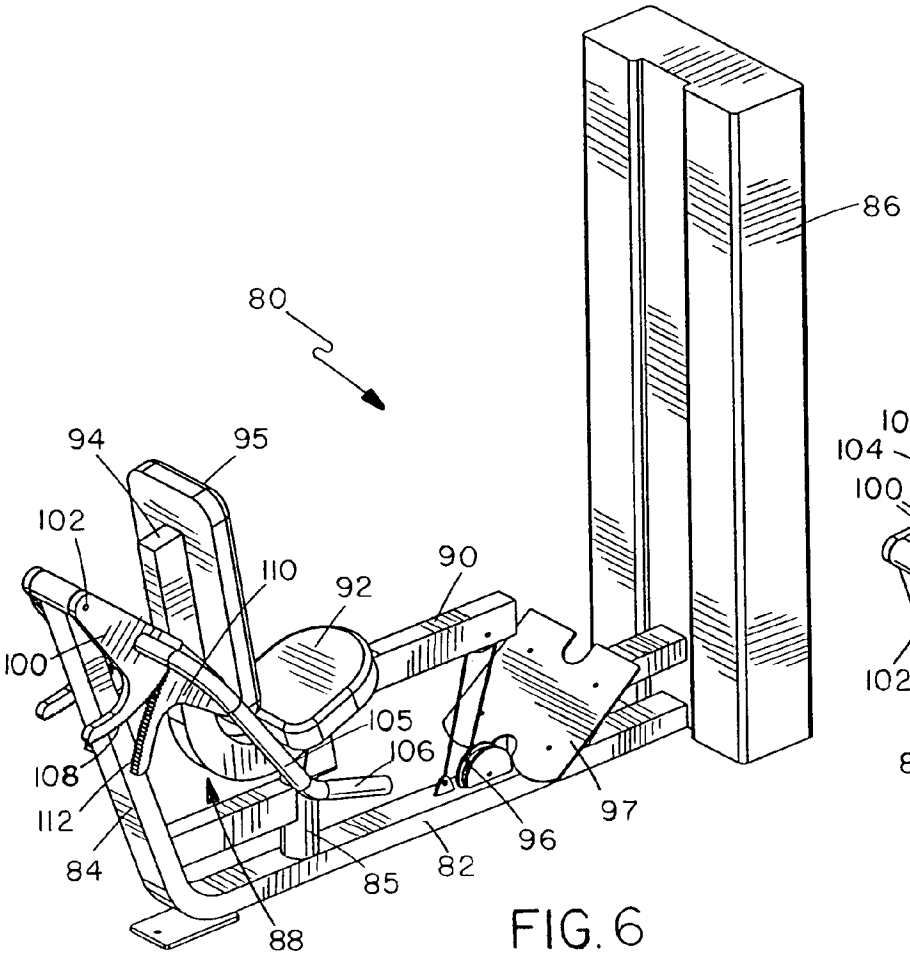
FIG. 6 is a perspective view similar to FIG. 5, illustrating the machine in an exercise end position.

An exercise arm 98 is pivotally mounted at the upper end of the upright strut 84 so as to extend forwardly on opposite sides of the user support frame. Arm 98 comprises a pair of parallel plates 100 with rear ends pivotally mounted on opposite sides of upright strut 84 via pivot pin 102, and a U-shaped exercise arm having a central section 104 secured to plates 100 as indicated in FIG. 5, and opposite arms 105 projecting forwardly from plates 100 on opposite sides of the user support frame, with user engaging portions or handles 106 at the forward ends of arms 105. Plates 100 also each have a forward, curved gear tooth edge or cam 108, and corresponding plates 110 are mounted on the rear of the user support frame with gear tooth edges 112 meshing with the gear teeth on the edges 108 of the plates 100. The matching gear-toothed cams 108, 112 translate downward movement of the exercise arm into rearward movement of the user support frame, and comprise the connecting link between the exercise arm and user support.

Figure 8:
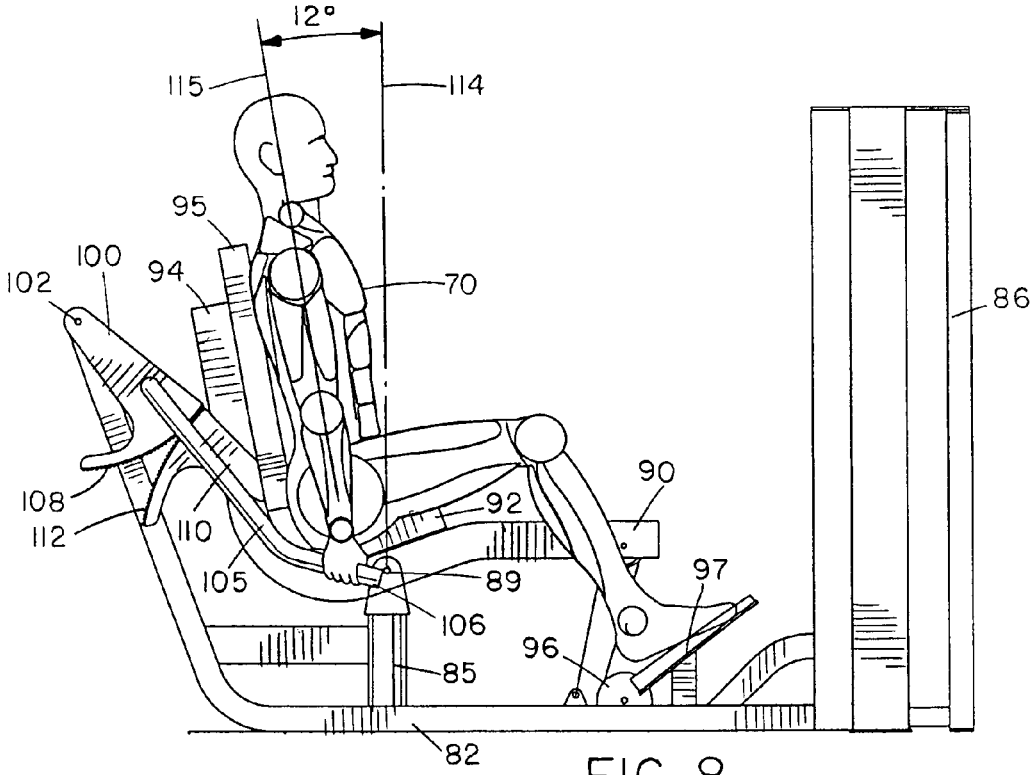
FIG. 8 is a side elevation view similar to FIG. 7, illustrating the exerciser's body position at the end of the exercise.
Figure 7:
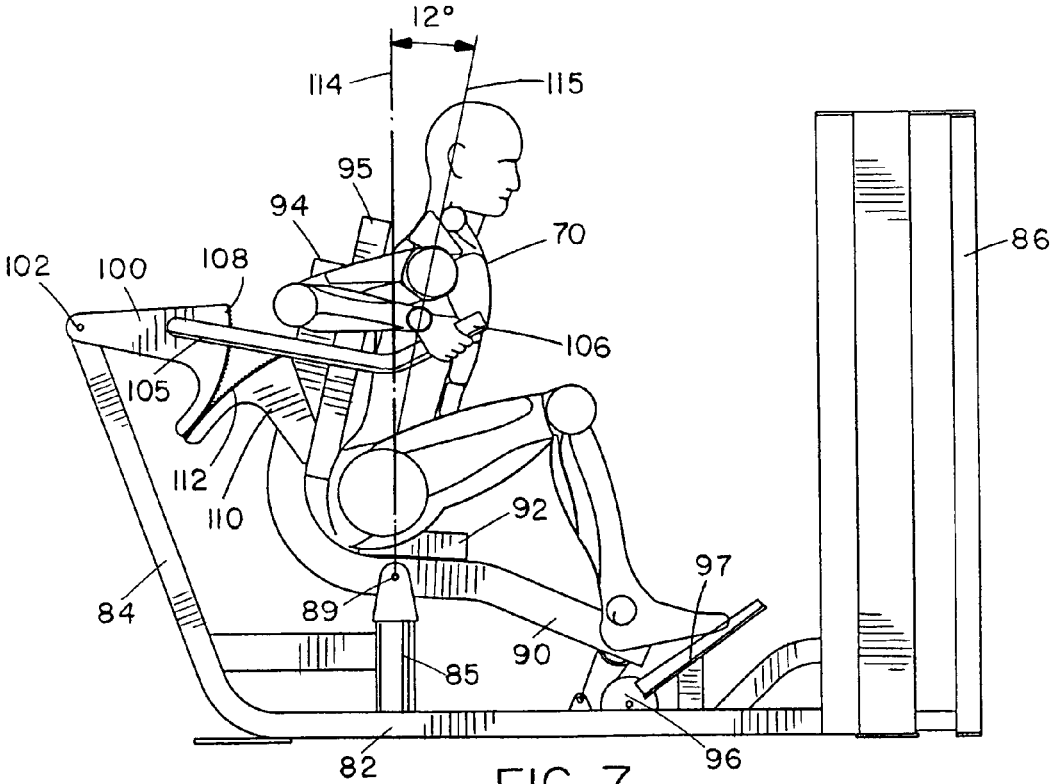
FIG. 7 is a side elevation view of the machine of FIGS. 5 and 6, illustrating an exerciser's body position at the start of the exercise.
Figure 9:
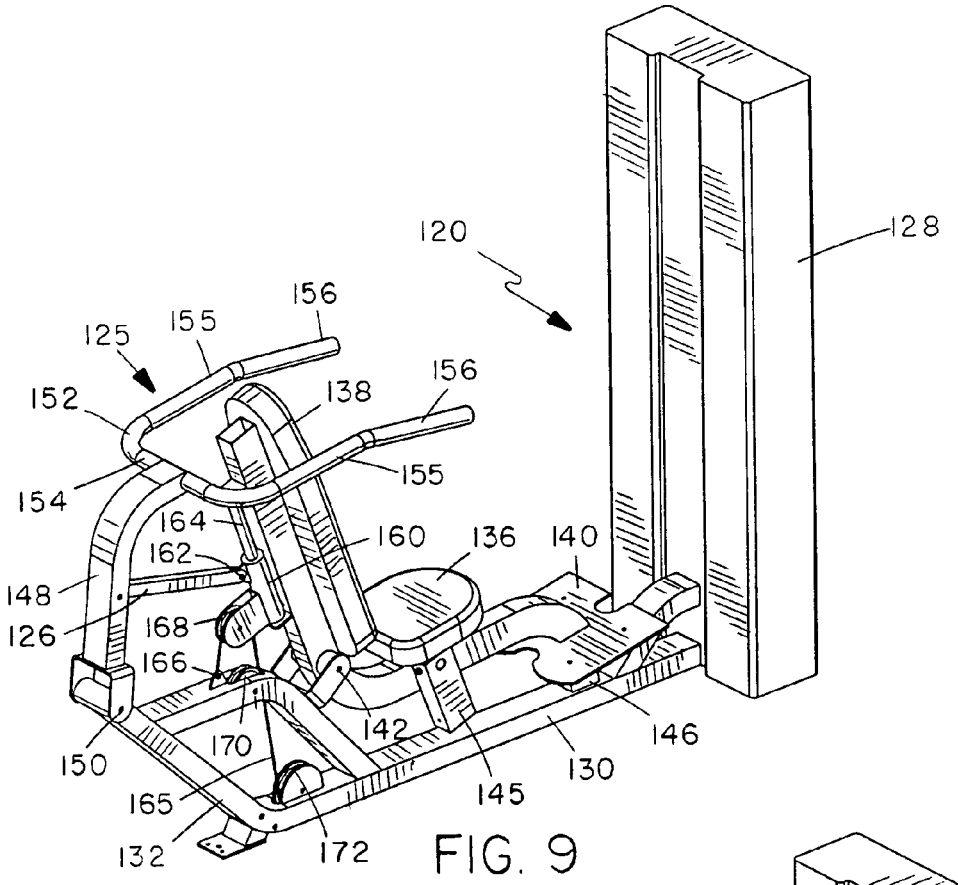
FIG. 9 is a front perspective view of a shoulder press exercise machine according to a third embodiment of the invention for performing shoulder press exercises, with the machine illustrated in a start position adopted at the beginning of an exercise movement.
Figure 10:
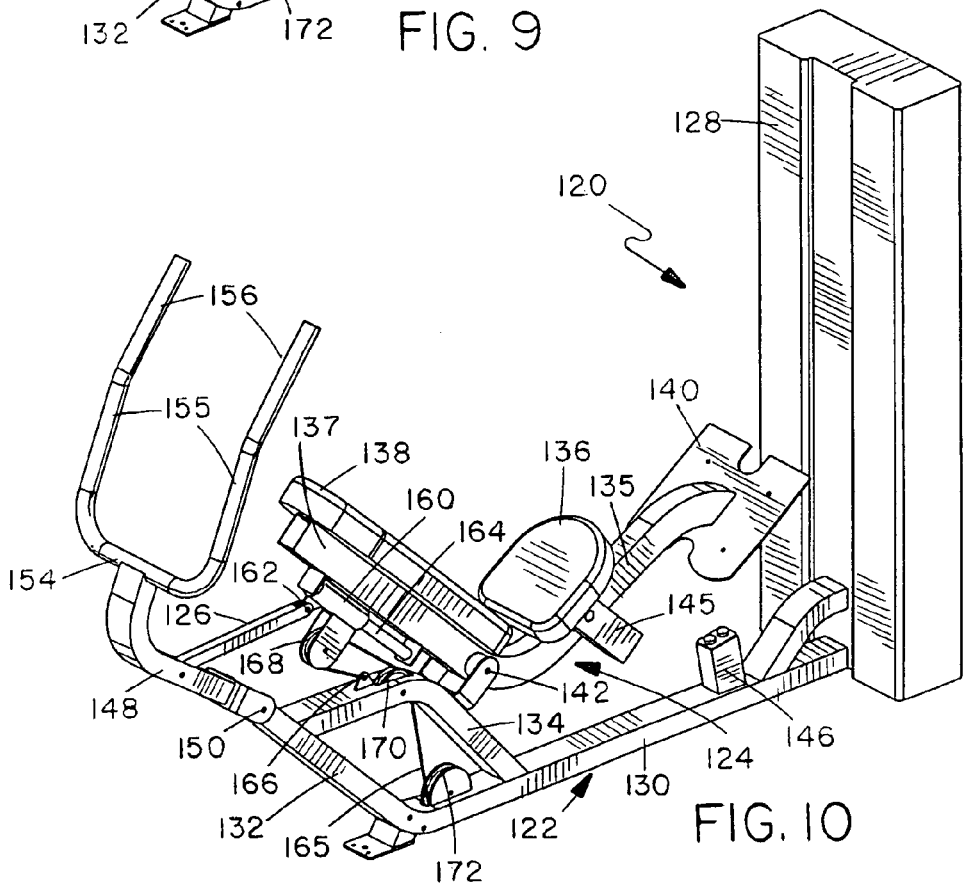
FIG. 10 is a perspective view similar to FIG. 9, illustrating the machine in an exercise ending position.

FIGS. 7 and 8 illustrate the user 70 performing a bar dip type of exercise, with FIG. 7 illustrating the starting position and FIG. 8 illustrating the finish position. The dotted line 114 is the gravitational center line of the user support pivot mount, while the dotted line 115 is the side center line of the user's body. In a free bar dip exercise, a user grips two parallel bars on opposite sides of their body. They then pull themselves into a position in which their arms and knees are bent while leaning slightly forwardly for balance. In the starting position using the exercise machine of this embodiment, as illustrated in FIGS. 5 and 7, the user support frame rests in a forwardly inclined position, with the back pad 95 inclined forwardly and the seat pad 92 inclined slightly downwardly. The user 70 sits on the seat and places their feet on the footplate 97, and grabs the handles 106 on each side, as illustrated in FIG. 7. This places them into a slightly forwardly inclined position, with their hands slightly below their shoulders and forward of the side center line 115 of the body, and their arms and legs bent. This closely mimics the starting position of a free bar dip exercise.

In a free bar dip exercise, the exerciser will press downwardly on the bars while raising their body until their arms are straight and aligned with the sides of their body. In the seated dip machine of FIGS. 5 to 8, a similar movement is carried out in order to move into the finish position of FIG. 8. The user 70 pushes the exercise arm downwards until their arms are straight down and aligned with the sides of their body. Pushing the handles of the exercise arm down causes the interlocking teeth on gears 108, 112 to rotate the user support in an anti-clockwise or rearward direction about pivot 89, moving the user from the forwardly inclined position of FIG. 7 into the reclined position of FIG. 8. The user ends with their arms extending straight downward and in line with the side centerline 115 of their body, mimicking the end position of a free bar dip exercise. The slight rearward movement from the position of FIG. 7 to that of FIG. 8 also mimics the natural rearward arc a person's upper body goes through when performing a free bar dip.

As in the previous embodiment, the user support pivot 89 is positioned directly under the exerciser 70, and a balanced portion of both the user support and exerciser is positioned on each side of the gravitational center line 114 of the pivot in both the starting and finish positions of FIGS. 7 and 8. The gravitational center line in this case runs very close to the centerline of the user's hip. The exerciser starts in a forward lean, approximately 12 degrees off vertical, and finishes in a rearward lean of approximately 12 degrees. This is the same start to finish positioning an exerciser would have when performing a bar dip exercise on free bars, without the disadvantages of free bar exercises. The user is placed in a back supported, forward lean at the starting position, mimicking the natural balancing position of an exerciser performing a bar dip. The exercise ends with the user's arms extending straight down the side centerline of their body in the finish position. Because the user is fully supported and not suspended, as they would be in a free bar exercise, and the exercise arm and user support have the ability to self-align to one another throughout the exercise movement, the handles 106 can be angled to provide a more comfortable starting and finishing hand position with less extreme bending to the wrist than would be encountered in a free bar dip exercise.

The combined weight of the user and user support is balanced on each side of the gravitational center line of the pivot in both the start and finish position, as in the previous embodiment, such that the initial resistive weight of the exercise arm is counterbalanced and there is substantially no resistance drop-off at the end of the exercise. Thus, there is no need to add a counter-balancing weight to offset the weight of the exercise arm assembly. The rocking movement of the user support makes the exercise enjoyable to perform, while the user is fully supported for safety and comfort throughout the exercise movement.

Figure 35B:
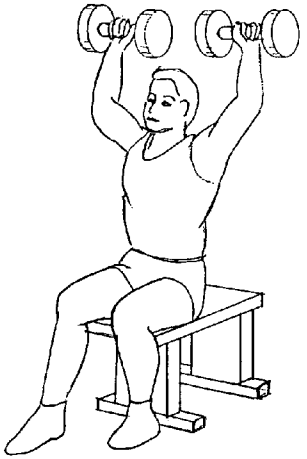
FIGS. 35*a* and 35*b* are schematic views illustrating an exerciser performing a free weight dumbbell press exercise, which is an exercise duplicated by the overhead press exercise machine of FIGS. 9 to 12.
Figure 35A:
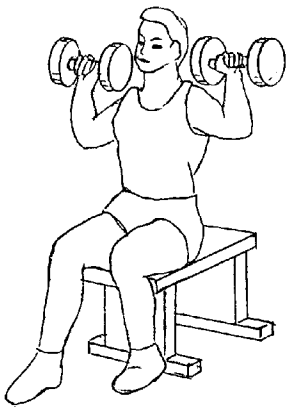

FIGS. 9 to 12 illustrate a shoulder press exercise machine 120 which duplicates a free weight overhead press exercise as illustrated in FIGS. 35*a* and 35*b* without the disadvantages of a free weight exercise, i.e. balance, coordination, and strength to follow the proper movement path, and possible injury if the proper movement is not followed. Instead, the shoulder press machine 120 constrains the user to follow the proper exercise path, while fully supporting the user's body throughout the exercise for comfort and safety.

The exercise machine 120 basically comprises a main frame 122, a user support frame 124 pivotally mounted on the main frame, an exercise arm 125 pivotally mounted on the main frame and linked to the user support frame by a connecting link 126, and an exercise resistance such as selectorized weight stack in housing 128 linked to the connecting link 126. The main frame 122 comprising a horizontal base section 130, a rearwardly inclined upright section or strut 132, and a pivot mount section 134. The user support frame 124 is generally L-shaped with a base 135 on which a seat pad 136 is adjustably mounted, and an upright 137 on which a back pad 138 is mounted. A foot plate or footrest 140 is secured to the forward end of the base 135. The frame 124 is pivotally mounted on the pivot mount section 134 via a pivot 142 located close to the junction between the base and upright sections of the user support frame, so that the pivot is positioned directly under the exerciser. The seat pad 136 is mounted on a strut or post 144 which is telescopically engaged in tube 145 to allow the height of the seat pad relative to the frame to be adjusted. A stop 146 on the main frame adjacent the forward end of the user support frame acts to support the user support frame in the starting position of FIGS. 9 and 11.

The exercise arm is similar to the previous embodiment, with a first elongate member or strut 148 having one end pivoted to the top of upright frame strut 132 via pivot 150, and a U-shaped member 152 having a central section 154 secured to the opposite end of strut 148 and opposite handle arms 155 extending on opposite sides of the user seat, with user engaging handles 156 at the ends of arms 155. However, the connecting link between the exercise arm and the user support frame is different in this embodiment, to produce the exercise movement desired for a shoulder press exercise. The connecting link 126 comprises an arm having a first end pivoted to an intermediate point on strut 148 via pivot 158 and a second end pivotally secured to a slide member 160 via pivot 162. The slide member 160 is slidably mounted on a rail or guide bar 164 mounted on the rear of the user support upright 137. The slide member 160 is also linked to the exercise resistance, which is a weight stack in this case, via a cable and pulley linkage. A cable 165 extends from an anchor 166 on the pivot mount section 134, over a pulley 168 mounted on the slide member 160, back over a pulley 170 on section 134, over a pulley 172 on the base 130 of the main frame beneath the slide, and then through the frame and into the weight stack housing, where it is linked to a selectorized weight stack in a conventional manner. The sliding linkage mechanism between the exercise arm and user support frame is similar to that described in co-pending application Ser. No. 10/171,236 of Webber, filed Jun. 12, 2002, the contents of which are incorporated herein by reference.

Figure 11:
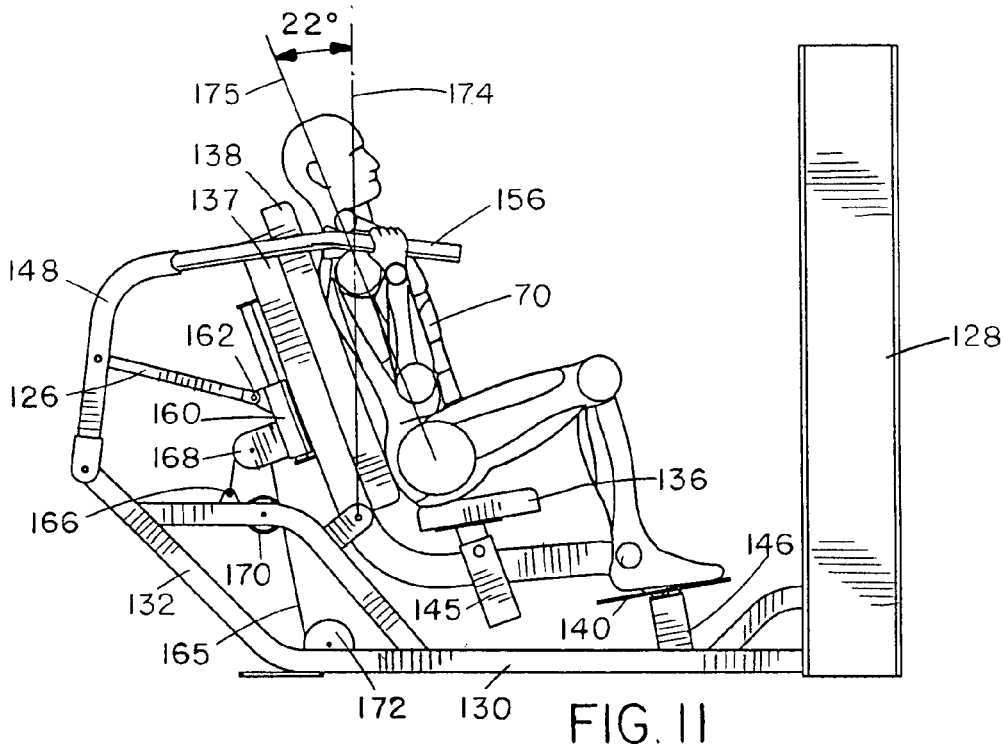
FIG. 11 is a side elevation view of the machine of FIGS. 9 and 10, illustrating an exerciser's body position at the start of the exercise.
Figure 12:
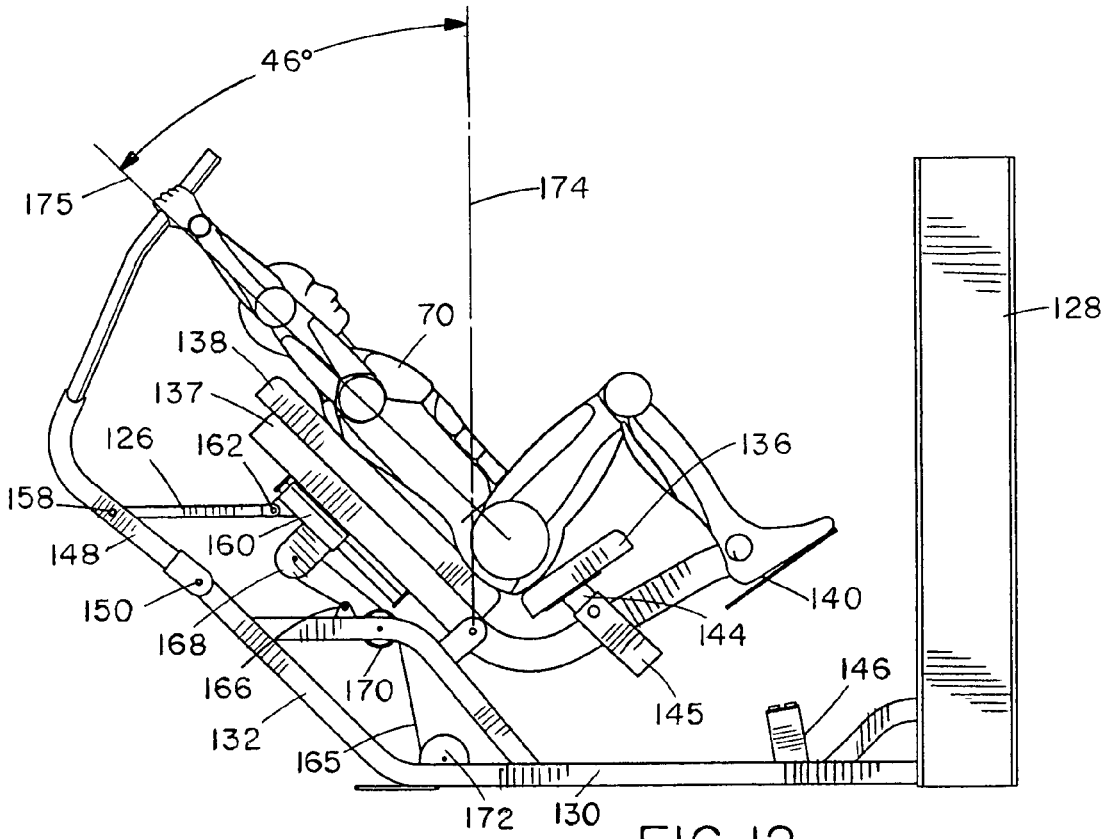
FIG. 12 is a side elevation view similar to FIG. 11, illustrating the exerciser's body position at the end of the exercise.

FIGS. 11 and 12 illustrate a user 70 performing a shoulder press exercise on the machine 120. To perform the exercise, the user sits on the seat in the start position of FIG. 11, where the seat is in a slightly rearwardly reclined position. The user places their feet on the foot rest 140, and grabs the handles 156. In FIGS. 11 and 12, the dotted line 174 represents the gravitational centerline of the user support pivot 142, which is the gravitational centerline of the user performing the exercise. The dotted line 175 represents the side centerline of the exerciser. As can be seen in FIG. 11, the start position places the user in a slightly reclined position, at an angle of around 22 degrees, with their hands at approximately shoulder level and forward of the side centerline of their body. This is equivalent to the start position of the user's body for a free weight shoulder press, as illustrated in FIG. 35*a*.

From the position of FIG. 11, the user pushes the handles upwards, rotating the exercise arm rearwardly. At the same time, the exercise arm pulls the connecting link upward, which in turn forces the linear slide member 160 upwards and causes the user support to rotate rearwards about pivot. Additionally, upward movement of the slide member lifts the selected weights in the weight stack via the cable and pulley linkage. The user is placed in a back supported position with their hands slightly forward of the shoulders in the start position, and then follows the slight natural arcing movement of a barbell press, finishing the exercise in a substantially reclined position of around 46 degrees to the gravitational centerline, with their arms fully extended and in line with the side centerline 175 of their body, as illustrated in FIG. 12. This substantially mimics the finish position of a free weight shoulder press exercise, as illustrated in FIG. 35*b*. The exercise movement provided with this machine therefore mimics the slight, natural arcing movement the arms go through when performing a barbell or dumbbell free weight shoulder press exercise.

As in the previous embodiments, it can be seen that the position of the user support pivot beneath the user's body distributes the weight of the user's body and the support frame on both sides of the gravitational centerline in both the start and finish position of the exercise. The starting position in this case places the user support pivot rearward of the exerciser's hips, with the gravitational centerline 174 in line with the centerline of their shoulders. While the majority of the user's body starts forward of the gravitational centerline, the user will rotate rearwards through this centerline during the exercise, and finish with the centerline bisecting the middle of their torso for a more evenly balanced distribution of weight at the end of the exercise. The combined weight of the user and user support will still have a reduced effect on the amount of starting resistance, since part of the user's weight is still placed rearward of the user support pivot, acting as a counterbalance to the exercise arm. By the same token, as the user passes rearward through the gravitational centerline, there is no appreciable drop off in resistance felt because of the amount of weight which still remains forward of centerline 174.

Also as in the previous embodiment, this machine fully supports the exerciser throughout the exercise movement so that they do not have to worry about balance and coordination, unlike a free weight exercise. The exercise arm and user support are linked to one another to self-align throughout the exercise movement, so that the handles can be angled for a more comfortable start and finish position.

Figure 13:
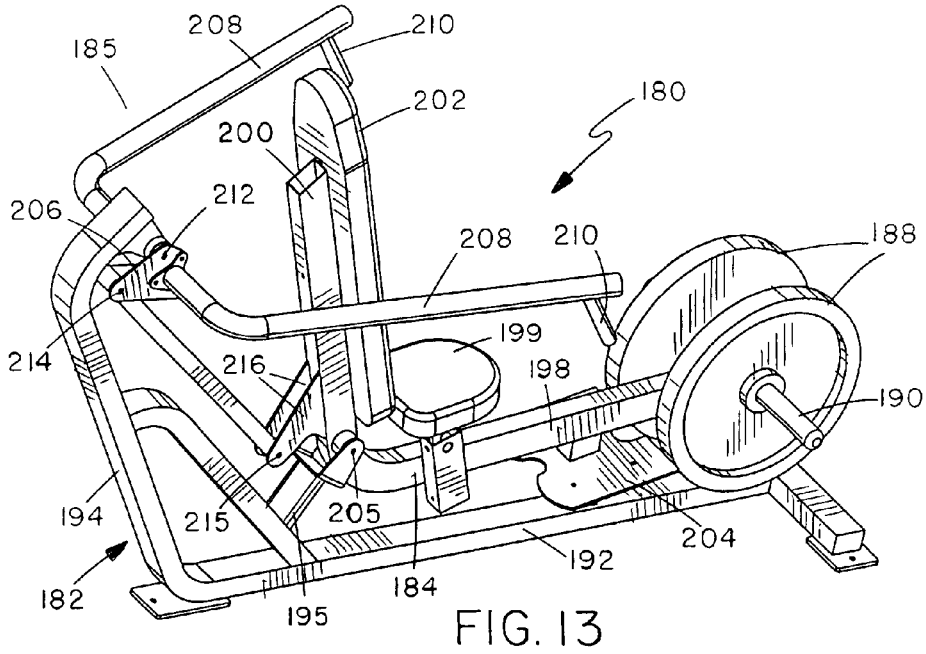
FIG. 13 is a rear perspective view of a chest press exercise machine according to another embodiment of the invention for performing bench press type exercises, with the machine illustrated in a start position adopted at the beginning of an exercise movement.
Figure 14:
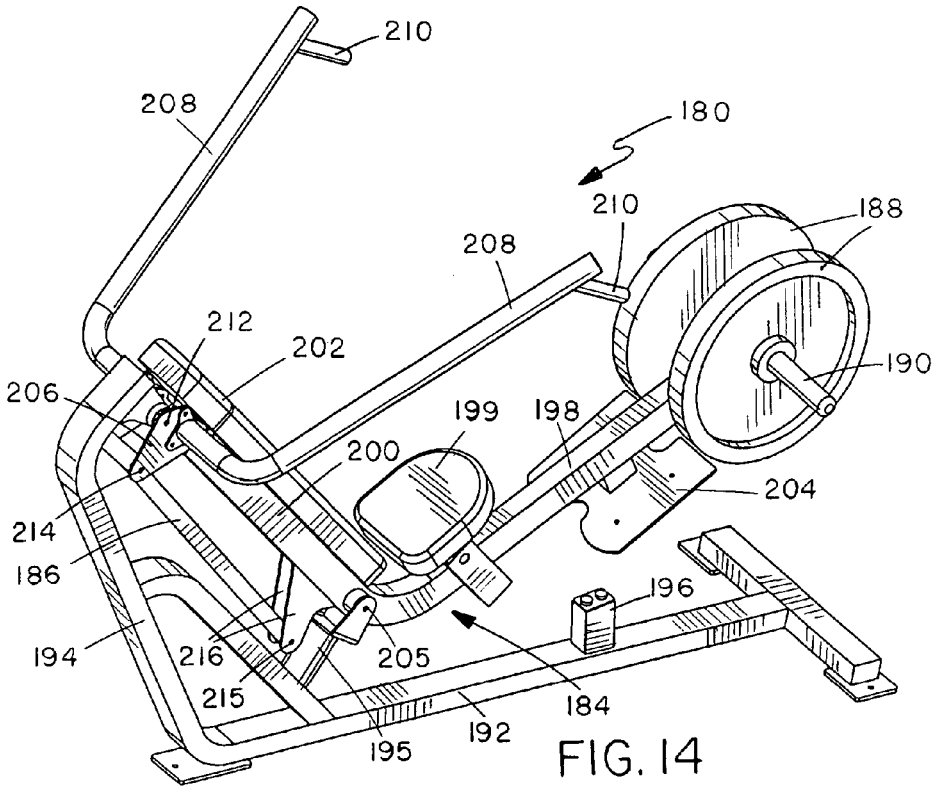
FIG. 14 is a perspective view similar to FIG. 13, illustrating the machine in an exercise ending position.
Figure 15:
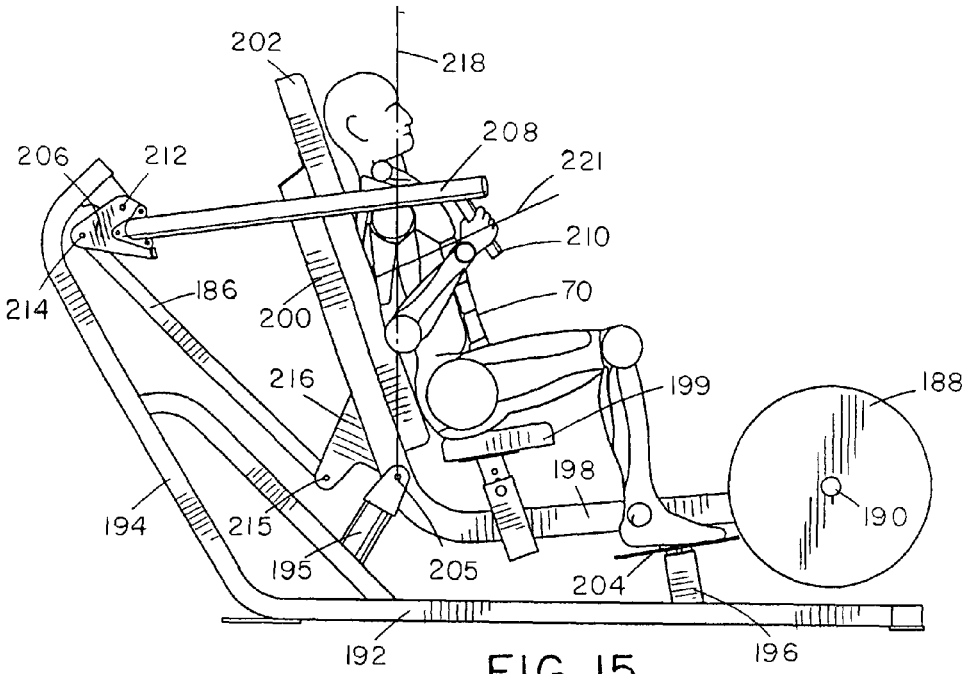
FIG. 15 is a side elevation view of the machine of FIGS. 13 and 14, illustrating an exerciser's body position at the start of the exercise.
Figure 16:
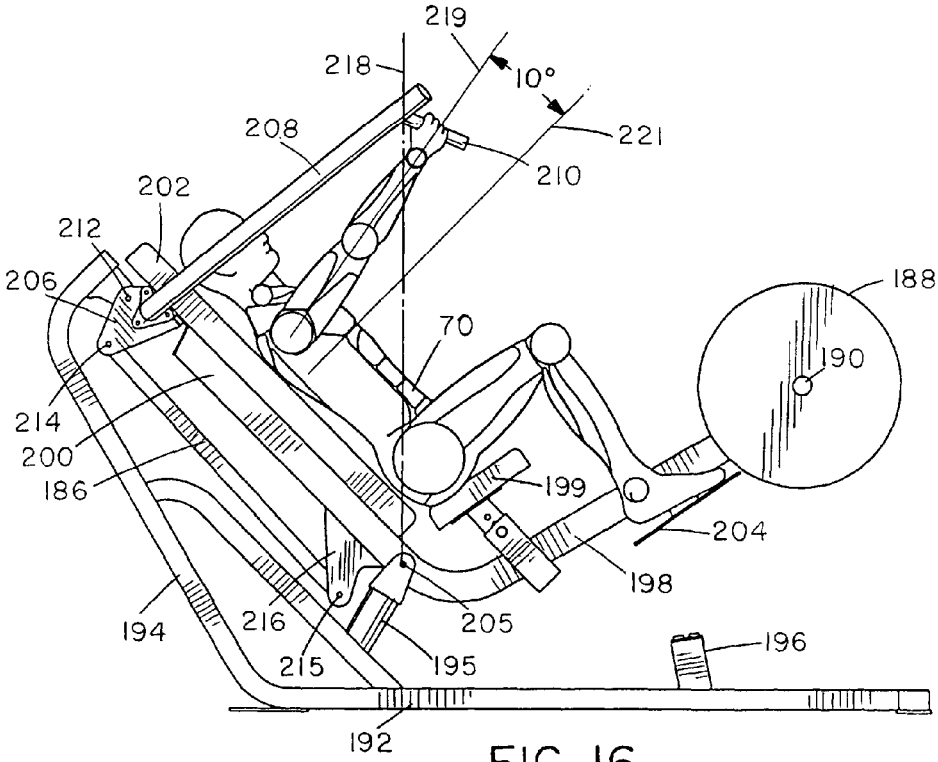
FIG. 16 is a side elevation view similar to FIG. 15, illustrating the exerciser's body position at the end of the exercise.
Figure 36A:
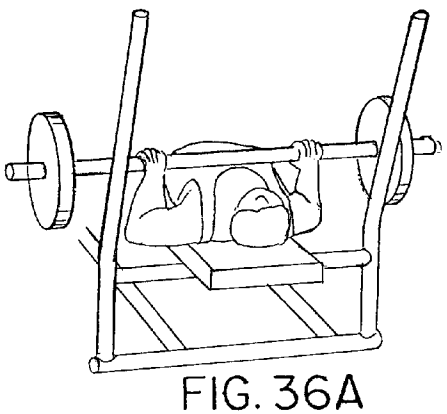
FIGS. 36*a* and 36*b* are schematic views illustrating an exerciser performing a barbell bench press exercise, which is an exercise duplicated by the chest press exercise machine of FIGS. 13 to 16.

FIGS. 13 and 14 illustrate the start and finish positions of a chest press exercise machine 180 according to another embodiment of the invention, while FIGS. 15 and 16 illustrate the user 70 performing a chest press exercise on this machine. This machine performs bench press type exercises similar to those depicted in FIGS. 36*a* and 36*b*, which show a free weight barbell bench press. The chest press machine 180 of this embodiment duplicates the movement carried out by an exerciser when performing a chest press or bench press with a free barbell or dumbbell, but is easier and more comfortable since the user's movement is guided while the user's body is fully supported throughout the exercise.

The machine 180 basically comprises a main frame 182, a user support frame 184 pivotally mounted on the main frame, an exercise arm 185 also pivotally mounted on the main frame, a connecting link 186 between the exercise arm and the user support frame, and an exercise resistance, which in this case comprises weight plates 188 mounted on weight receiving pegs 190 at the forward end of the user support frame. The main frame 182 has a base 192, a rearwardly inclined upright 194, and a pivot mount section 195. A stop post 196 on the base supports the user support frame in the start position.

The user support frame 184 is generally L-shaped with a base 198 on which a seat pad 199 is adjustably mounted in a similar manner to the previous embodiment, and an upright 200 on which a back pad 202 is mounted. A footrest or foot plate 204 is secured beneath the base at an appropriate position and orientation for supporting the feet of a user seated on the seat pad. The weight plates 188 are positioned forward of the footrest 204. The frame 184 is pivotally supported on the pivot mount section of the main frame via pivot 205, which is at a similar position to the pivot 142 of the previous embodiment.

The exercise arm 185 comprises a U-shaped member with a central section pivoted to the upper end of the upright 194 via pivot bracket 206, and opposite arms 208 extending on opposite sides of the user support, as in the previous two embodiments. A pair of downwardly directed handles 210 are mounted at the forward ends of handle arms 208 for gripping by a user with their hands in a suitable orientation for performing a chest press exercise. Pivot bracket 206 is pivoted at one position to the upper end of upright 194 via pivot 212, and at another position to the upper end of connecting link 186, via pivot 214. The lower end of the connecting link is pivoted via pivot 215 to a pivot bracket 216 at the lower end of the user support upright 200, so that upward rotational movement of the exercise arm results in rearward rotational movement of the user support.

In an alternative arrangement, a single or two-part exercise arm may be adjustable in order to vary the start position for user's with different arm lengths. The bracket or plate 206 may be replaced with one or two range-of-motion or ROM plates, and each exercise arm may be releasably secured to the ROM plate, at a selected angular position. In this case, the arm will be pivoted to the ROM plate, which has a series of spaced openings extending in a part circular path. The arm is secured at a selected angular orientation relative to the plate by a releasable push pin or the like extending through a selected opening. A ROM arrangement for an adjustable exercise arm is described, for example, in U.S. Pat. No. 6,090,020 of Webber, the contents of which are incorporated herein by reference.

Figure 36B:
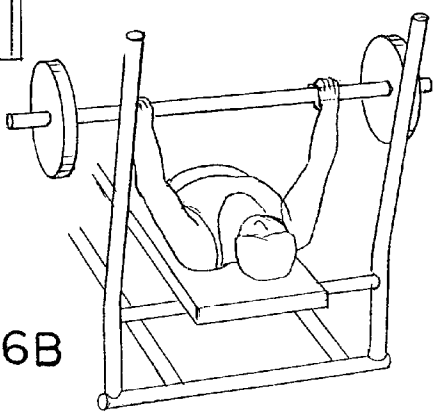

FIGS. 15 and 16 illustrate a user performing a chest press exercise on the machine 180. The user first sits on the seat in the start position of FIG. 15, resting their feet on footrest 204 and grabbing the handles 210 with their hands. The user starts the exercise in a slightly reclined position, with their hands slightly below their shoulders and slightly in front of, and in line with, their chest. This mimics the start position illustrated in FIG. 36*a* for a barbell bench press. Pushing the exercise arm forwards into the position of FIG. 16 pushes the connecting link 186 downward, which in turn pushes the user support, causing it to rotate rearward about its pivotal connection 205 to the main frame. The exercise arm and user are rotated during the exercise to produce an exercise path with approximately 10 degrees of arc. This moves the user from a slightly reclined position to a substantially reclined position, ending with their arms extending straight forward and their hands at a slightly higher position relative to their shoulders, as compared with the start position. As indicated in FIG. 16, the user's arms in the end position extend along a line 219 which is at an angle of around 10 degrees to a line 221 perpendicular to the back pad 202. This end position mimics the end position for a free barbell bench press, as illustrated in FIG. 36*b*, and mimics the slight, natural arcing movement the arms go through in the "chest to chin" movement of a free barbell bench press.

In the machine of FIGS. 13 to 16, the connecting link pushes the user support to cause it to rotate rearward. The vertical dotted line 218 in FIGS. 15 and 16 indicates the perpendicular, vertical centerline of the user support pivot, which is the gravitational centerline of the user performing the exercise. As in the previous embodiment, the position of pivot 205 places the centerline 218 rearward of the user's hips and in line with the user's shoulders. Thus, the majority of the user starts the exercise in a position forward of the centerline 218, and the user's body rotates rearwardly through the centerline throughout the exercise, finishing with the centerline bisecting the middle of their torso for a more evenly balanced weight distribution at the end of the exercise. This produces similar weight distribution results to the shoulder press machine of the previous embodiment, since the user support pivot positions in both machines are identical. The combined movement of the user support and exercise arm produces a ten degree rise in hand position from start position, which is similar to the natural arcing pattern of the free barbell bench press exercise, which has the bar traveling in a "chest to chin" exercise motion. At the same time, the exercise machine 180 will be more comfortable and easier for an inexperienced exerciser, guiding the user throughout the movement to follow the desired exercise path.

Figure 18:
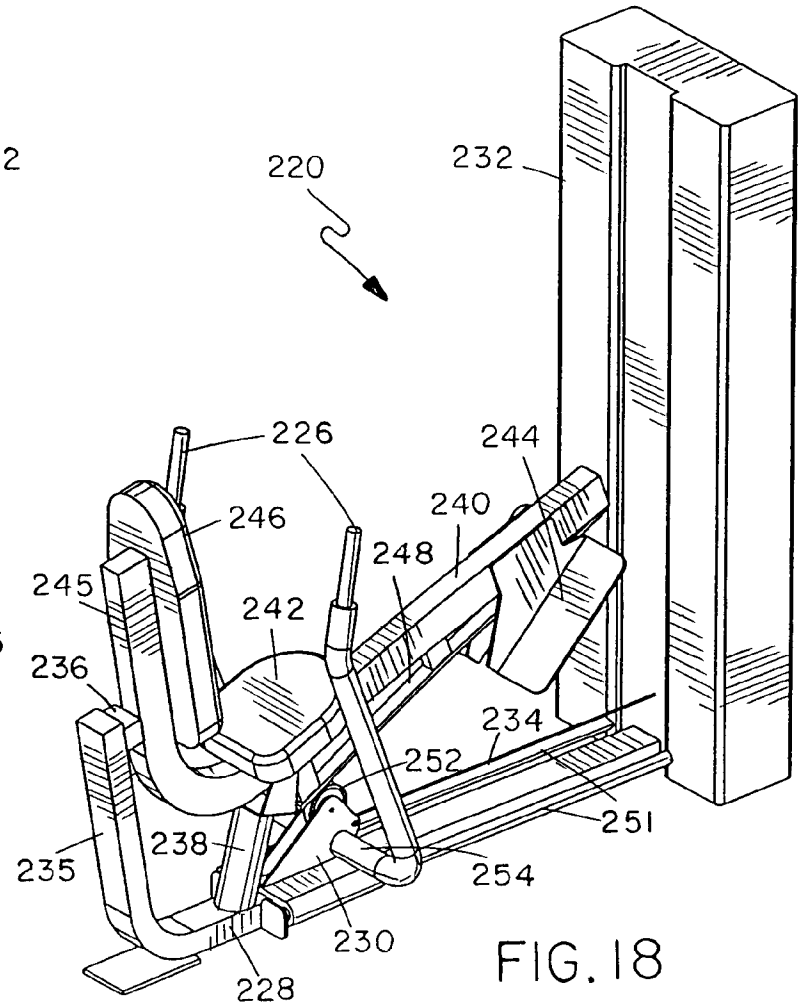
FIG. 18 is a rear perspective view similar to FIG. 17, illustrating the machine in an exercise ending position.
Figure 17:
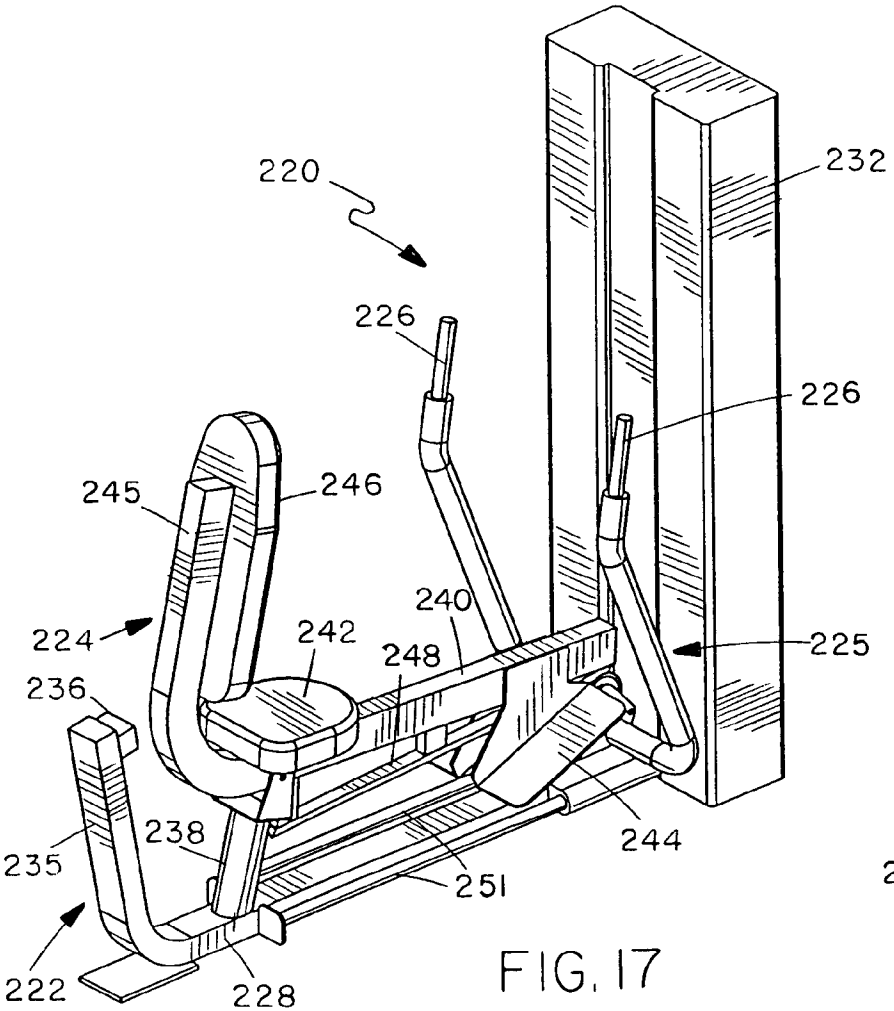
FIG. 17 is a rear perspective view of a mid-row exercise machine according to another embodiment of the invention for performing rowing exercises, with the machine illustrated in a start position adopted at the beginning of an exercise movement.
Figure 19:
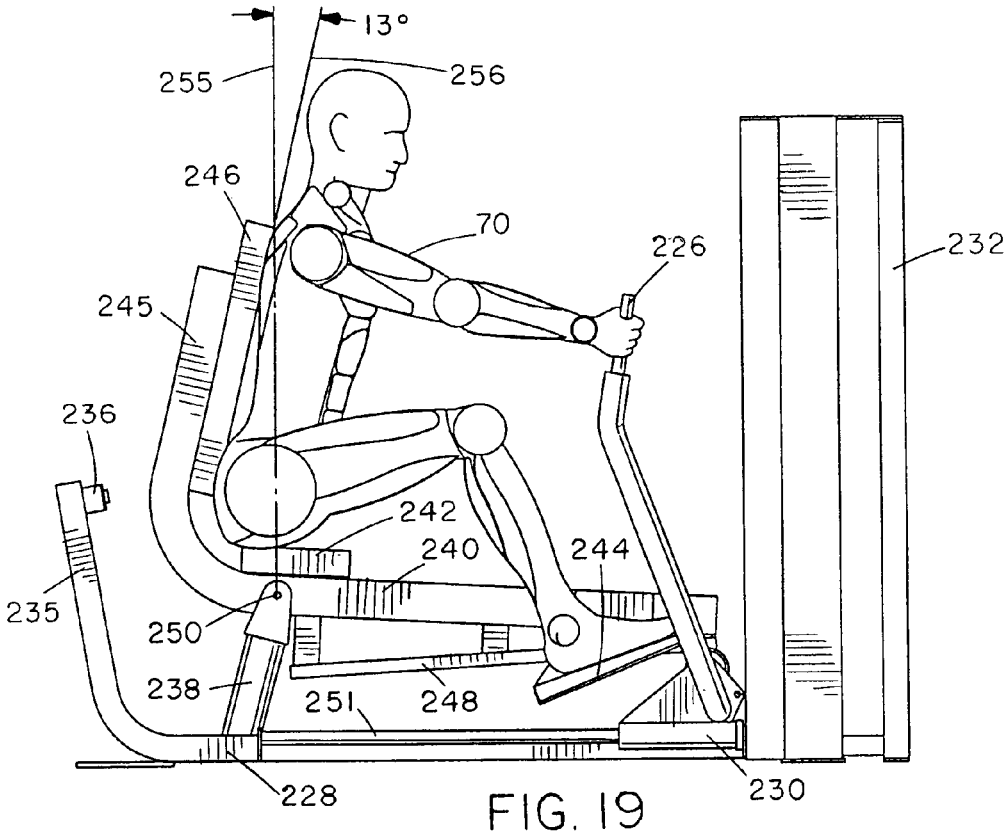
FIG. 19 is a side elevation view of the machine of FIGS. 17 and 18, illustrating an exerciser's body position at the start of the exercise.
Figure 20:
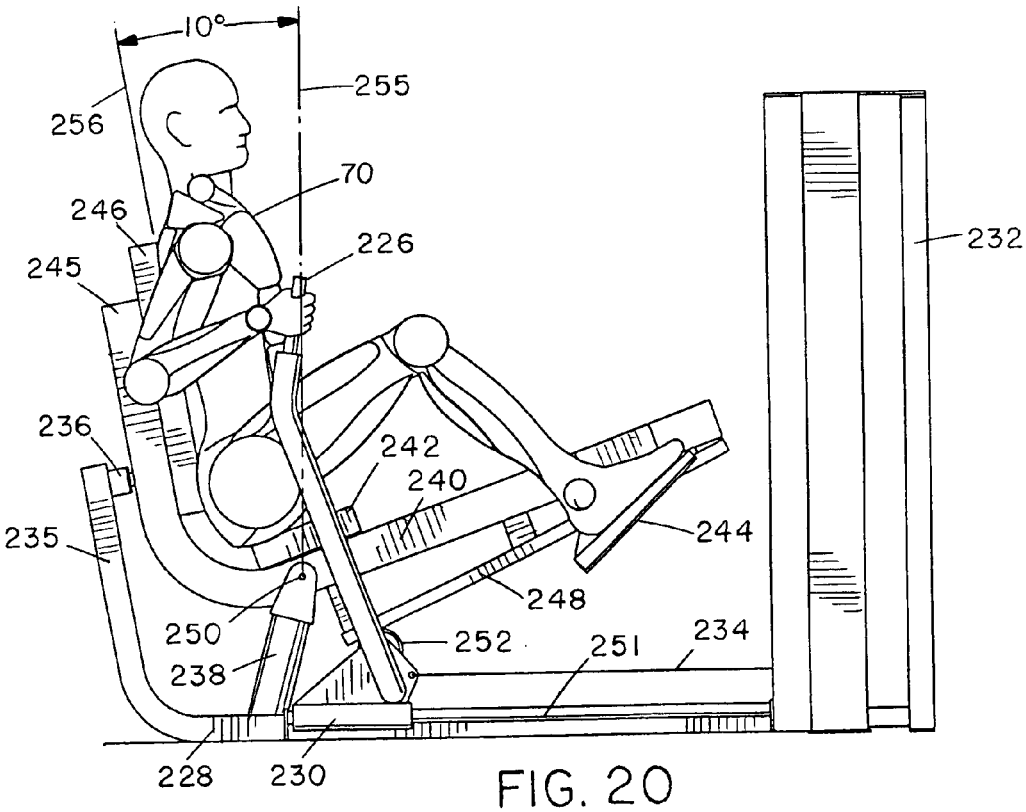
FIG. 20 is a side elevation view similar to FIG. 19, illustrating the exerciser's body position at the end of the exercise.

FIGS. 17 to 20 illustrate a mid row exercise machine 220 according to another embodiment of the invention, for performing a rowing exercise equivalent to the free rowing exercise illustrated in FIGS. 37*a* and 37*b*. FIG. 17 illustrates the machine in a start position while FIG. 18 illustrates the finish position, with FIGS. 19 and 20 illustrating the same positions with a user 70 performing the exercise.

The exercise machine 220, as in the previous embodiments, comprises a main frame 222, and a user support 224 pivotally mounted on the frame. In this case, a U-shaped exercise arm 225 with handles 226 at its free, upper ends is slidably mounted on the base 228 of the frame 222 via linear slide 230. The linear slide 230 is linked to an exercise resistance, in this case a weight stack in housing 232, via a cable and pulley linkage, most of which is concealed within the weight stack housing, with the cable 234 of the linkage connected to the slide 230 as indicated. The linear slide or sliding wedge 230 is also linked to the underside of the user support 224, as will be described in more detail below. The sliding wedge linkage between the exercise arm and user support is similar to that described in co-pending application Ser. No. 10/195,665 of Webber, filed Jul. 12, 2002, the contents of which are incorporated herein by reference.

The main frame also has a slightly rearwardly inclined upright strut 235 at the rear end of base 222, which has a stop pad 236 at its upper end forming a rest for the user support in the finish position of FIG. 20, and a pivot mounting post 238 extending upwardly from the base at a position spaced forwards from upright strut 235. The user support 224 is generally L-shaped, and has a base 240 on which a seat pad 242 is mounted, with a pair of foot rests or foot plates 244 secured adjacent the forward end of base 240, and an upright 245 supporting back pad 246. A guide bar or track 248 is mounted on the underside of the base 240 of the user support so as to extend at an upwardly inclined angle from the rear end to the forward end, as best illustrated in FIGS. 19 and 20. The user support is pivoted to the pivot mount 238 via a pivot 250 located beneath the seat pad 242.

The linear slide or wedge 230 is slidably engaged on a pair of parallel, linear guide bars 251 on the base 228 of the frame, as best illustrated in FIG. 18, and has a wheel 252 at its upper end for rolling engagement on the guide bar or track 248 on the underside of the user support base. The central portion 254 of the U-shaped exercise arm is mounted on the slide or wedge 230, as best illustrated in FIG. 18. Rearward linear motion of the exercise arm is translated into rearward rotational movement of the user support with this arrangement.

FIGS. 19 and 20 illustrate a user 70 performing a rowing type of exercise, also known as a mid row exercise, on the machine 220. In FIGS. 19 and 20, dotted line 255 is the gravitational centerline of the user support pivot 250, while dotted line 256 represents the orientation of the user support back rest, or the back of the user when seated on the support. To perform the exercise, the user sits on the seat with the user support in the position illustrated in FIG. 19, and places their feet on the foot support plates 244 while gripping handles 226 with their arms straight out in front. The user support is initially positioned in a back supported, forwardly inclined position, so that the user's body is initially at a forward lean of around 13 degrees off vertical. The user's arms extend straight forwards with their hands slightly below shoulder level, which is equivalent to the starting position for a free rowing exercise as in FIG. 37*a*.

The user then pulls handles 226 towards their body in a rowing action, simultaneously pulling the slide or wedge 230 along the rails 251. This wedges the wheel 252 along the angled user support guide bar 248, rotating the user support rearwardly about pivot 250, and moving the user from a slightly forwardly inclined position to a reclined position, ending with their arms pulled back and their hands at a slightly lower elevation, relative to their shoulders, than the starting position. This follows a natural rearward arcing rowing motion. The end position of the user in FIG. 20 is similar to the end position for a free rowing exercise as illustrated in FIG. 37*b*. This exercise machine therefore mimics the slight, naturally arcing movement of the upper body when rowing a boat or exercising on a rowing machine, without allowing the user to bend at the waist, which is undesirable and can occur with a free rowing exercise.

In the exercise machine of this embodiment, the user support pivot 250 is positioned directly under the exerciser, in a similar position to the user support pivot in the seated dip machine of FIGS. 5 to 8. The gravitational centerline 255 runs very close to the centerline of the user's hip, allowing a balanced portion of the user and user support to be positioned on each side of the gravitational centerline in both the start and finish position. Because the user support seat 242 rises upward as it rotates and the exercise arm travels in a straight line, the positioning of the exerciser's hands, relative to their shoulders, will be slightly higher in the starting position than the finish position. This involves more of the back muscles and combines low and high lat pull movements in one exercise, which is not possible with a conventional rowing machine exercise using a cable.

Figure 21:
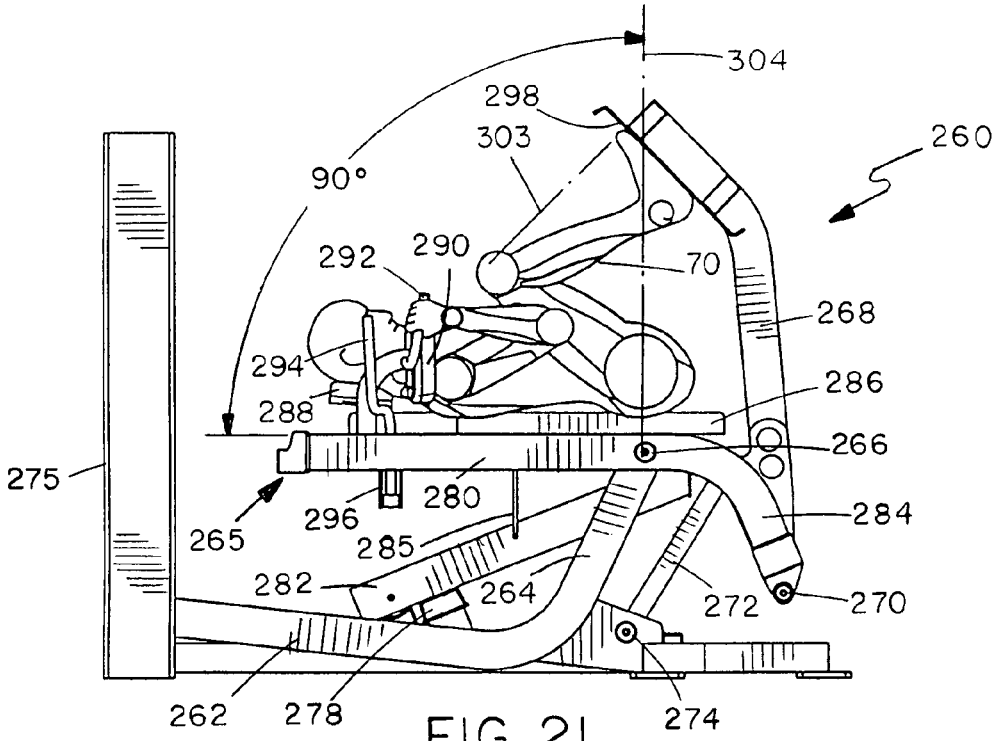
FIG. 21 is a side elevation view of a lying leg press exercise machine according to another embodiment of the invention for performing squat type exercises, with the machine illustrated in a start position adopted at the beginning of an exercise movement and the user in the start position on the machine.
Figure 22:
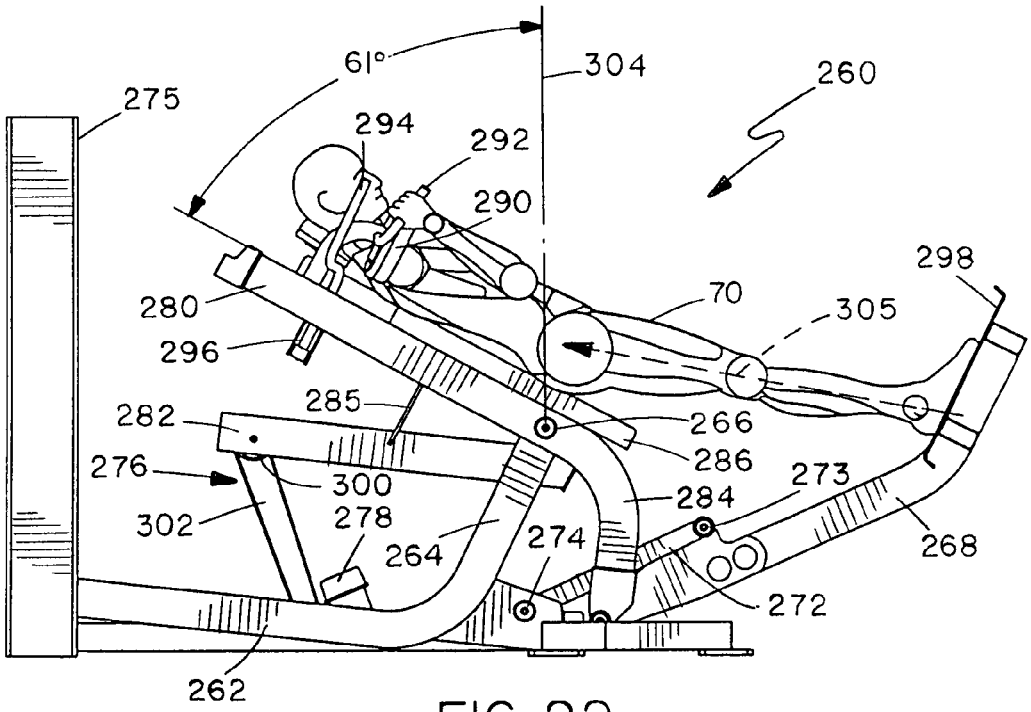
FIG. 22 is a side elevation view similar to FIG. 21, illustrating the user and machine in an exercise ending position.
Figure 23:
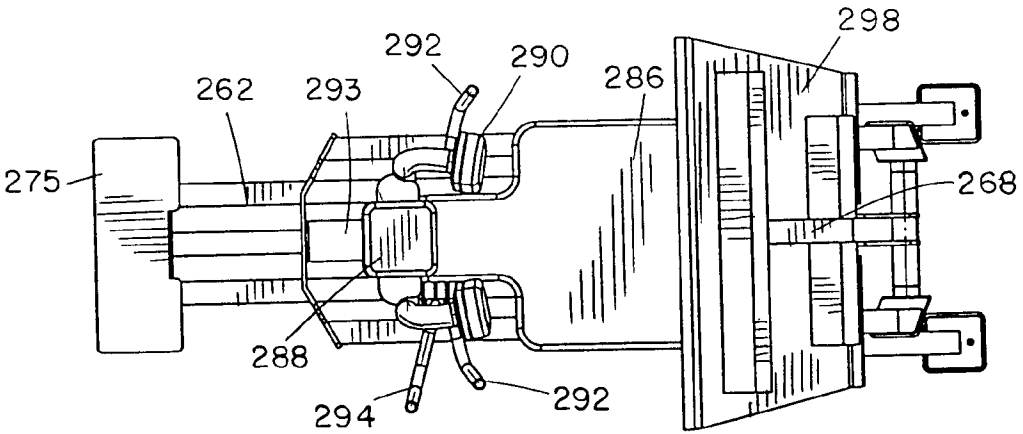
FIG. 23 is a top plan view of the machine of FIGS. 21 and 22, illustrating the position at the start of the exercise.
Figure 24:
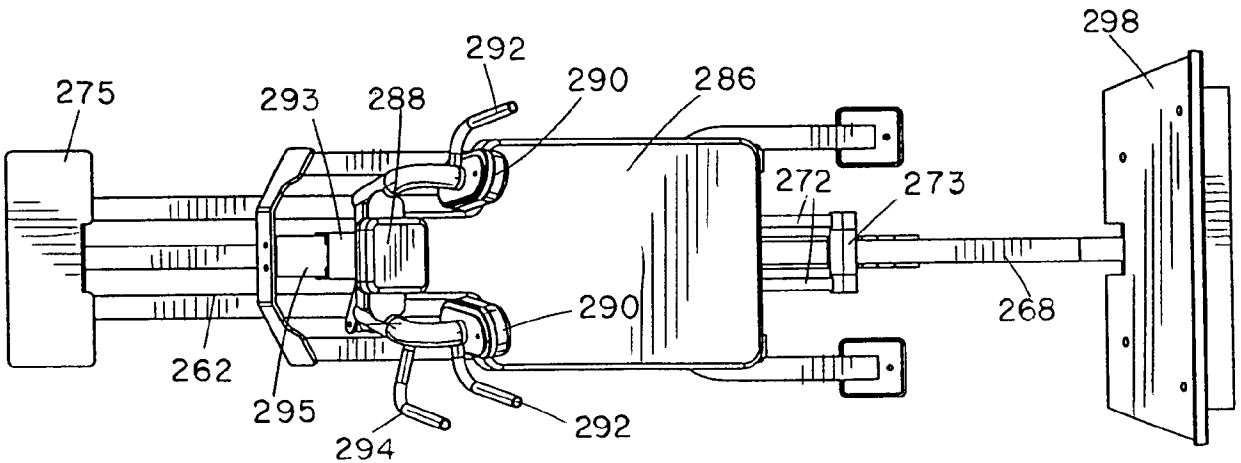
FIG. 24 is a top plan view similar to FIG. 23, illustrating the machine position at the end of the exercise.

FIGS. 21 to 24 illustrate a lying leg press exercise machine 260 for performing squat type exercises equivalent to the free squat exercise illustrated in FIGS. 38*a* and 38*b*. FIG. 21 illustrates the start position for the exercise, with a user 70 in the start position on the machine, while FIG. 22 illustrates the end position of the user and machine. FIGS. 23 and 24 illustrate top plan views of the machine in the start and end position, without the user.

The machine 260 has a main frame comprising a horizontal base section 262 and an upright pivot mount section 264, a generally Y-shaped user support frame 265 pivoted on the pivot mount section 264 at pivot 266, and an exercise arm 268 having a lower end pivoted to the forward end of the user support frame 265 at pivot 270. The exercise arm 268 has a user engaging foot plate 298 at its upper end. A connecting link 272 pivotally connects the exercise arm to the base section 262 of the main frame via pivots 273,274 at opposite ends of link 272, so that forward rotational movement of the arm 268 results in upward rotational movement of the user support.

The user support frame 265 is linked to an exercise resistance, in this case a selectorized weight stack in housing 275, via a cable and pulley mechanism 276, only part of which is visible in the drawings. The cable and pulley linkage 276 includes a pulley 300 at the rear end of the lower support 282 of the user support, and a cable 302 which extends around pulley 300 from an anchor (not visible) on the frame, and then extends rearwardly into the weight stack housing for linking to the weight stack in a conventional manner. A support post or stop 278 on the base section of the frame beneath the user support 265 provides a rest for the user support in the start position of FIG. 21.

As noted above, the user support frame 265 is generally Y-shaped, with an upper support 280 and a lower support 282 extending rearwardly at an angle to the upper member, with the upper support 280 having a downwardly curved tail portion 284 at its forward end which is pivotally secured to the exercise arm via pivot 270 at its lower end. A brace 285 extends between the upper and lower supports 280,282 at an intermediate point in their length for added support. A primary support back pad 286 is mounted on the upper support 280, and a secondary support assembly, consisting of a head rest 288, two shoulder pads 290, and two hand grips 292, is mounted at the rear end of the upper support. A user reclining on the back pad can place their feet on foot plate 298, as indicated in FIGS. 21 and 22.

The secondary support assembly is adjustably mounted on the upper support via sliding mount 293 which is slidably mounted on a central strut 295 of the upper support 280 (see FIG. 24), and secured in a selected position via a spring loaded pull pin 296 (see FIGS. 21 and 22). Handle 294 is provided for adjusting the position of the secondary support assembly. This permits the spacing between the secondary support assembly and foot plate 298 to be adjusted for users with different leg lengths.

FIGS. 21 and 22 illustrate a user 70 performing a squat type or lying leg press exercise on the machine 260. The user first lies on the back pad with the machine in the start position of FIG. 21, with their shoulders braced against the shoulder pads 290, and places their feet on the foot plate 298. They then push the foot plate 298 forward. While performing the exercise, the user may also grab the handles 292 for added stability. The starting position of FIG. 21 places the user in a substantially horizontal, back supported position with their legs bent, thighs against the torso, and knees aligned with the toes, as indicated by dotted line 303. This corresponds to the starting position of FIG. 38*a* for a free barbell squat exercise, without the difficulty in balance and coordination in reaching this position when standing. The vertical dotted line 304 in FIGS. 21 and 22 represents the perpendicular centerline of the user support pivot 266, which is also the gravitational centerline of the user performing the exercise.

As indicated in FIG. 21, the user support backrest starts at an angle of 90 degrees to the vertical centerline 304, i.e. in a horizontal orientation. When the exercise arm 268 is pushed forward by the user pushing against the foot plate 298, the connecting link 272 pulls the pivot connection point 270 between the exercise arm and user support downward, which in turn forces the user support to rotate upward about its pivotal connection 266 to the main frame. This also moves the user from a horizontal to an upwardly inclined orientation, with their legs straight out along line 305 and slightly angled to the upper torso, and resistive force directed up the legs to the hips. This mimics the ending position of a standing squat exercise as illustrated in FIG. 38*b*. This exercise therefore closely mimics the movement of a standing squat type exercise, but without the risk of strain to the exerciser's lower back, since the resistive force is directed to the hips and the back is properly supported. This eliminates spinal compression and improper lower back arching, providing a safer, more comfortable exercise.

Unlike the previous embodiments, the connecting link joins the exercise arm to the main frame rather than the user support, and the exercise arm is pivotally mounted on the user support rather than the main frame. Thus the exercise arm is mounted to, and travels with, the user support. However, it is still directly linked to the main frame via the connecting link. This linkage connection controls the movement of the exercise arm and ultimately the movement of the user support, maintaining the automatic and continuous adjustment and alignment between the user support and exercise arm.

The user support pivot 266 is positioned directly under the exerciser and the gravitational centerline 304 runs very close to the centerline of the user's hip, allowing a balanced portion of both the user support and exerciser to be positioned on each side of the gravitational centerline. At the end of the exercise, the user is raised to approximately 61 degrees to the vertical with a balanced portion of the weight of the user support, user, and exercise arm on opposite sides of line 304. The exercise machine 260 has a primary user support or back pad 286, a secondary user support (head support pad and shoulder pads), and an additional user support comprising hand grips 292, all of which remain in the same relative positions throughout the exercise movement.

Figure 25:
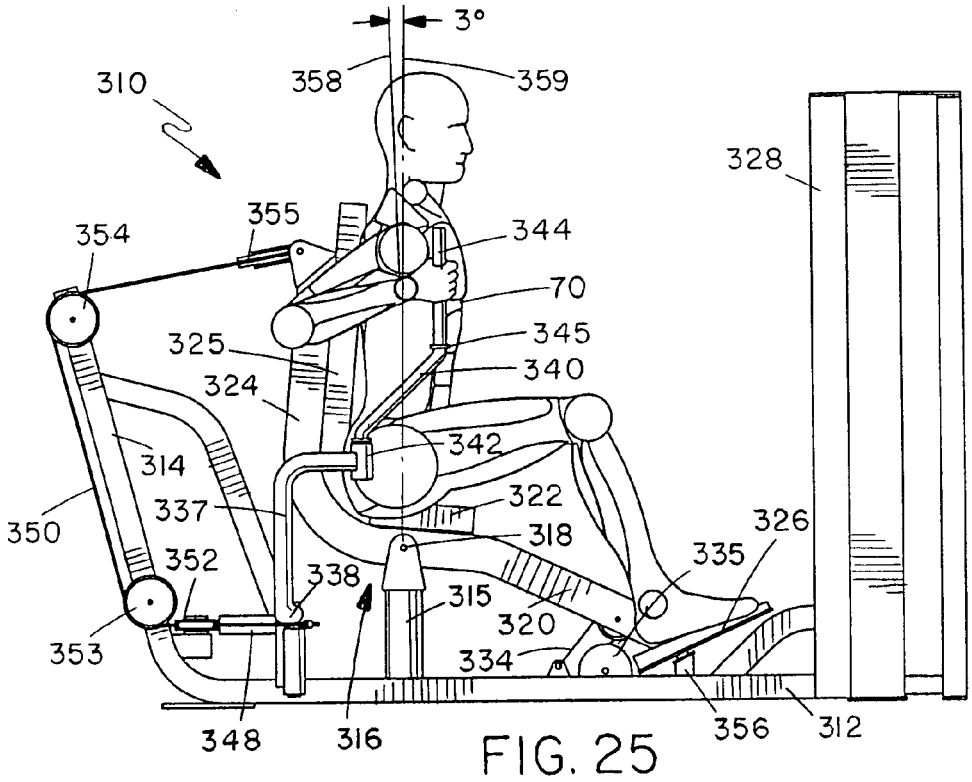
FIG. 25 is a side elevation view of a pec fly exercise machine according to another embodiment of the invention for performing fly type exercises, with a user seated on the machine in a start position adopted at the beginning of an exercise movement.
Figure 26:
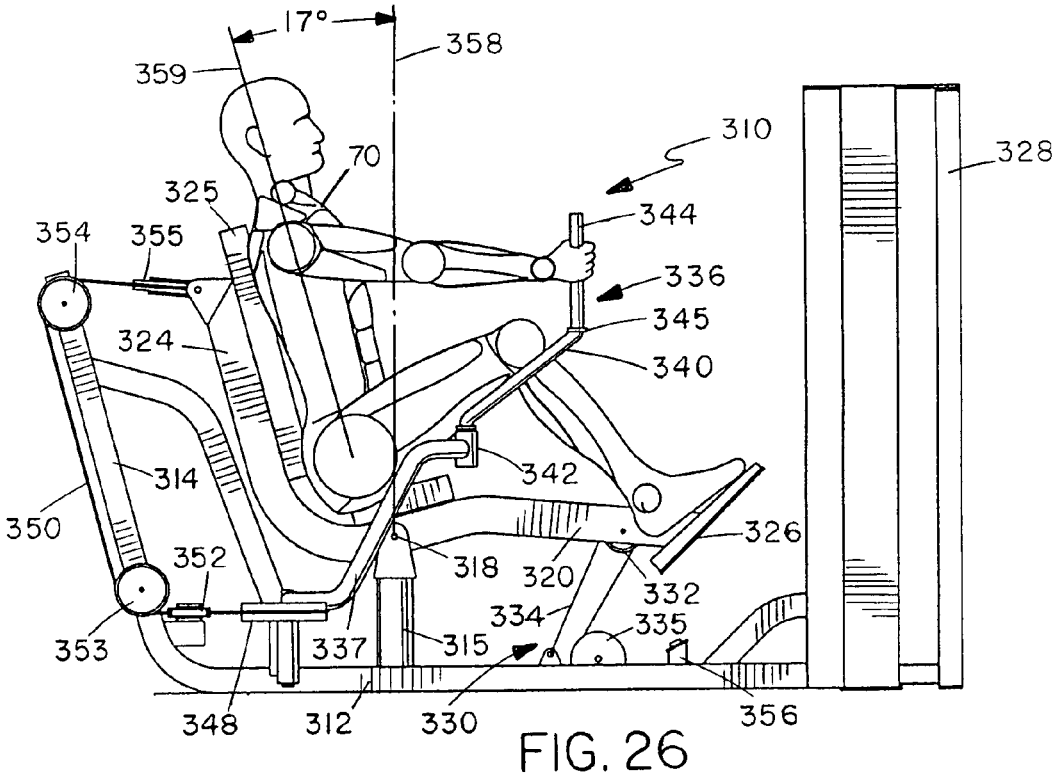
FIG. 26 is a side elevation view of the machine of FIG. 25, illustrating the user and machine in an exercise ending position.
Figure 27:
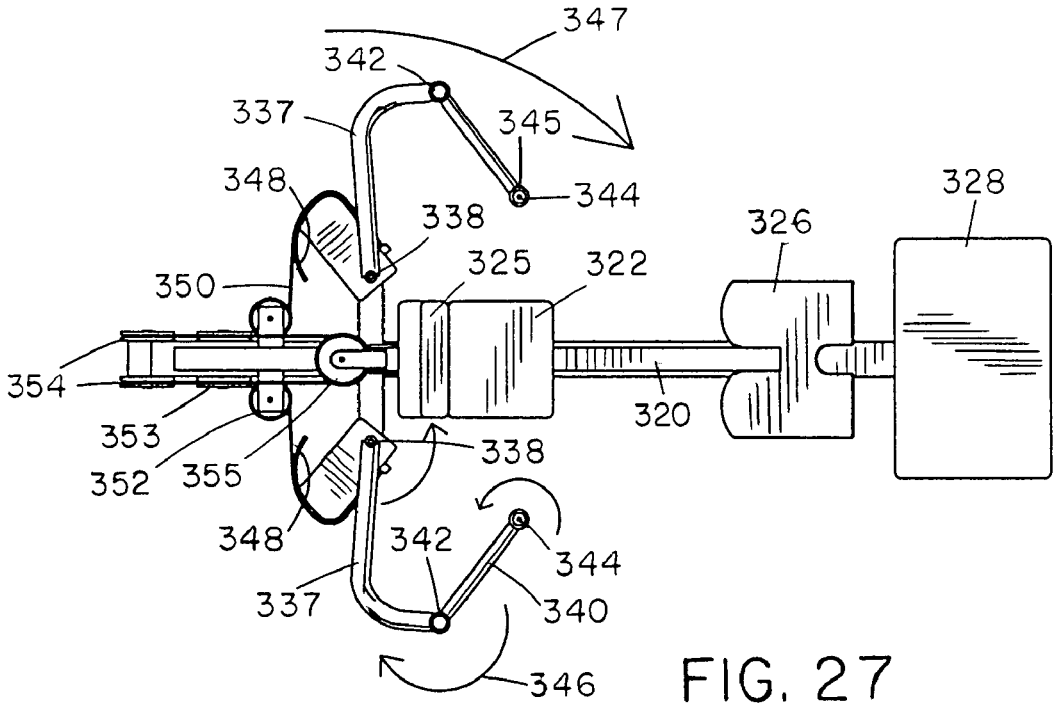
FIG. 27 is a top plan view of the exercise machine of FIG. 25 in the start position.
Figure 28:
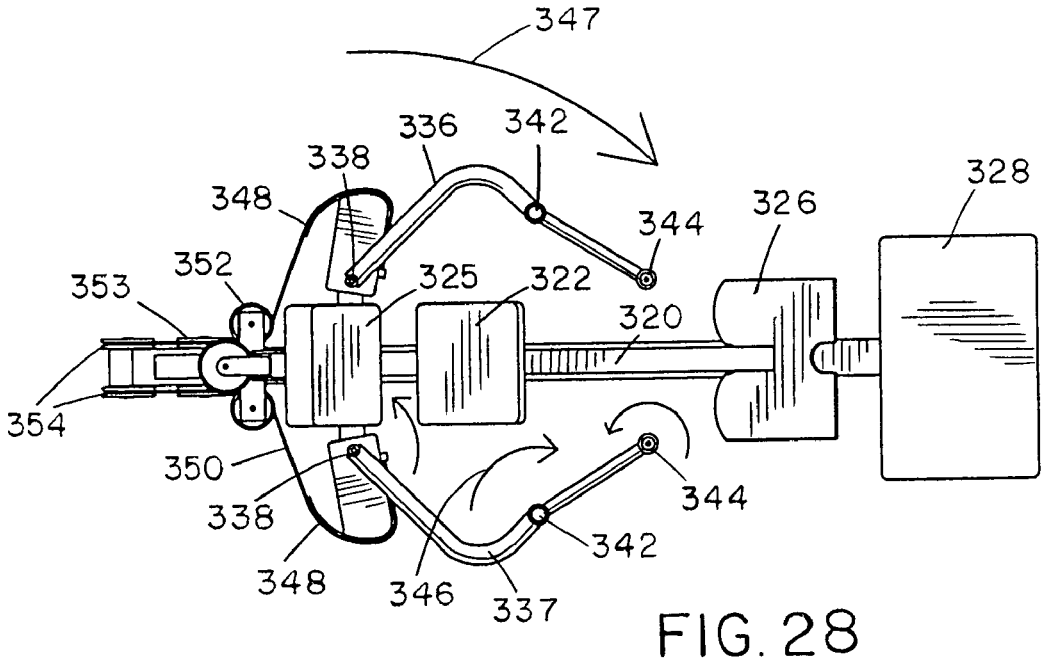
FIG. 28 is a top plan view similar to FIG. 27, illustrating the exercise end position.

FIGS. 25 to 28 illustrate a pectoral fly ("pec fly") exercise machine 310 according to another embodiment of the invention for performing pec fly exercises similar to the free weight pectoral fly exercise illustrated in FIGS. 39*a* and 39*b*, but without the disadvantages of a free weight exercise. FIGS. 39*a* and 39*b* illustrate a flat/straight pectoral fly exercise. Similar exercises are performed with the exerciser in a decline position on a downwardly reclined back rest, and in an incline position on an upwardly inclined back rest, in order to carry out decline and incline pectoral fly exercises, involving different muscles. The pectoral fly machine of this embodiment is designed to combine all three pectoral fly exercises in one machine, as will be described in more detail below. FIGS. 25 and 27 illustrate the start position of the machine, while FIGS. 26 and 28 illustrate the end position, with FIGS. 25 and 26 illustrating a user 70 performing a pectoral fly exercise on the machine.

The machine of FIGS. 25 to 28 has a similar base frame and user support arrangement to the seated dip machine of FIGS. 5 to 8 and the mid row machine of FIGS. 17 to 20. However, the exercise arm and connecting link arrangement is quite different from these embodiments. The pec fly machine 310 has a main frame comprising a base section 312, a rear upright 314, and a pivot mounting post 315 on the base section. A generally L shaped user support 316 is pivotally mounted on the pivot mounting post 315 via pivot 318. The user support 316 has a base 320 on which a seat pad 322 is mounted, and an upright 324 on which back pad 325 is mounted. A foot rest or foot plate 326 is mounted at the forward end of the base 320. An exercise resistance comprising a selectorized weight stack in housing 328 is linked to the base of the user support via a cable and pulley linkage 330, including a pulley 332 at the forward end of the base 320 adjacent the foot plate, and a cable 334 extending from an anchor on the base of the main frame, around pulley 332, around a second pulley 335 on the frame base, and then into the weight stack housing to extend around additional guide pulleys before linking to the weight stack in a conventional manner.

A pair of multi-part, articulating exercise arms 336 are rotatably mounted via pivot shafts 338 at their first ends on the base section 312 of the main frame, one on each side of the user support, as best illustrated in FIG. 27. Each exercise arm 336 has a first elongate part 337 having a first end pivoted on pivot shaft 338 and a second end, and an elongated handle 340 which has a first end rotatably mounted on the second end of part 337 for rotation about pivot 342. A user-engaging grip 344 is rotatably mounted on the second end of handle 340 for rotation about pivot 345. The pivotal connection between each handle and the respective exercise arm allows the handles to rotate inwardly and outwardly relative to their attachment to the exercise arms, as indicated by arrows 346 in FIGS. 27 and 28, so that the combined movement of the exercise arm and elongated handle about pivots 338 and 342 results in forward and rearward elliptical travel paths (see arrow 347).

A resistance cam 348 is mounted on each pivot shaft 338. A cable or flexible link 350 has a first end attached to a cam 348 of a first exercise arm, and extends over a first series of pulleys 352,353,354 mounted on the rear upright of the main frame, a swivel pulley 355 pivotally mounted at the upper end of the user support frame, and then around a second series of pulleys 354,353,352 on the opposite side of the rear upright, before attaching to the cam 348 of the second exercise arm. This is the connecting link between the user support and exercise arm, and ensures that forward rotational movement of one or both exercise arms results in rearward rotational movement of the user support.

FIG. 25 illustrates a user 70 seated on the user support with the exercise machine in the start position. The user sits on the seat in a slightly forwardly incline position, and places their feet on foot pad 326, which rests on a support post 356 on the base of the frame in the start position. They grab the hand grips 344 and push the hand grips and associated exercise arm forwards into the end position of FIGS. 26 and 28. In the start position, the user's upper body is inclined forwardly at an orientation of around 3 degrees to the gravitational centerline 358, with line 359 of FIG. 25 indicating the side centerline of the user's upper body. Gravitational centerline is the perpendicular or vertical centerline through the user support pivot 318. The user's elbows are bent with the arms out to the side and the hands slightly below the shoulders, mimicking the start position of the arms for a free weight pec fly in FIG. 39*a*, while the body is forwardly inclined, in position for an incline pectoral fly. Pushing the exercise arms forward causes the cams 348 mounted on the exercise arm pivot shafts to rotate, which pulls the cable 350 reeved around the swivel pulley 355 mounted at the upper end of the user support. This causes the user support 316 to pivot rearward about pivot 318 against the exercise resistance linked to the forward end of the user support. This action moves the user from a forwardly inclined position to a slightly reclined position, ending with their arms extending forward in front of their body, similar to the ending position of the arms for a free weight pec fly exercise, as illustrated in FIG. 39*b*, while the body is in a decline pec fly position.

FIGS. 27 and 28 illustrate the movement of the three parts of each articulating exercise arm, comprising the first parts, elongated handles, and user-engaging grips, from the start to the end position of the exercise. The three pivot axes 338, 342 and 345 replicate the joint movement of the shoulder, elbow, and wrist, respectively, when performing a free weight pectoral dumbbell fly exercise.

The user support pivot 318 is positioned directly under the user in this exercise machine, as in the previous embodiments. In this case, the gravitational centerline 358 runs very close to the centerline of the user's hip, allowing a balanced portion of the user support and user to be positioned on each side of the line 358 in both the start and end position. Because the user support seat rises upward as it rotates while the exercise arms remain in the same horizontal plane, the positioning of the user's hands, relative to their shoulders, will be slightly higher in the start position than the end position. This, coupled with the fact that the user is in all three pectoral fly positions (decline, flat/straight, and incline) during the exercise, allows this exercise machine to combine all three possible pectoral fly exercises in one exercise movement for greater muscle involvement. In the start position, the user is in an incline pectoral fly position, and travels through a flat or straight pec fly position during the exercise, finishing the exercise in a decline pectoral fly position. This produces an enhanced workout which saves time and money, because three machines or exercise stations providing three pec fly exercises are combined into one.

Figure 29:
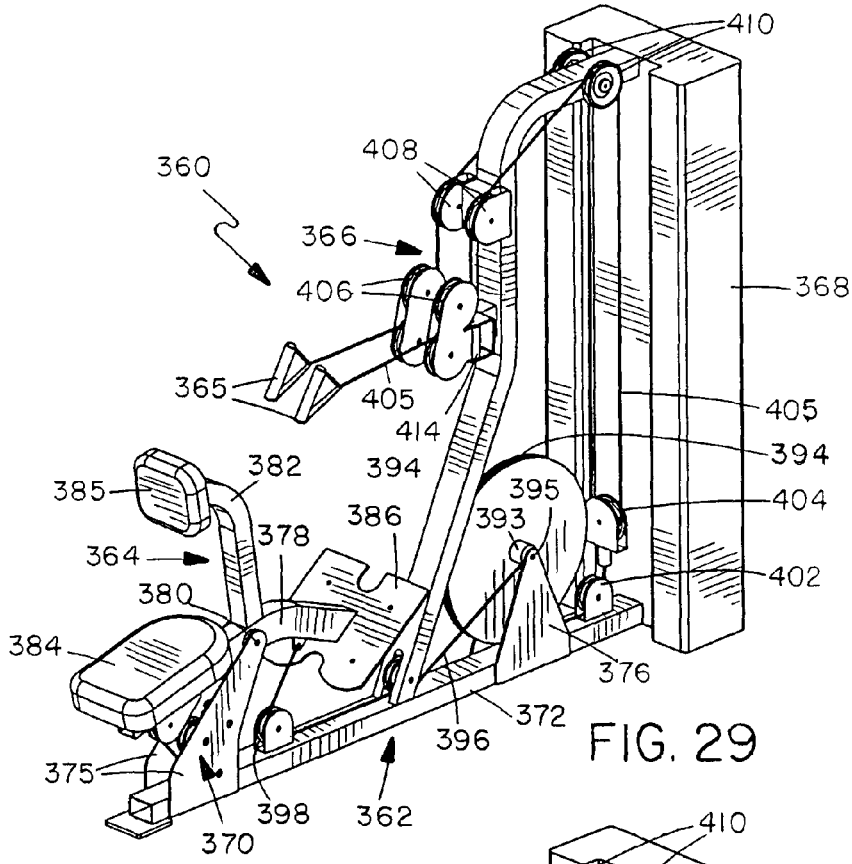
FIG. 29 is a front perspective view of a rear deltoid exercise machine according to another embodiment of the invention for performing rear deltoid exercises, with the machine illustrated in a start position adopted at the beginning of an exercise movement.
Figure 30:
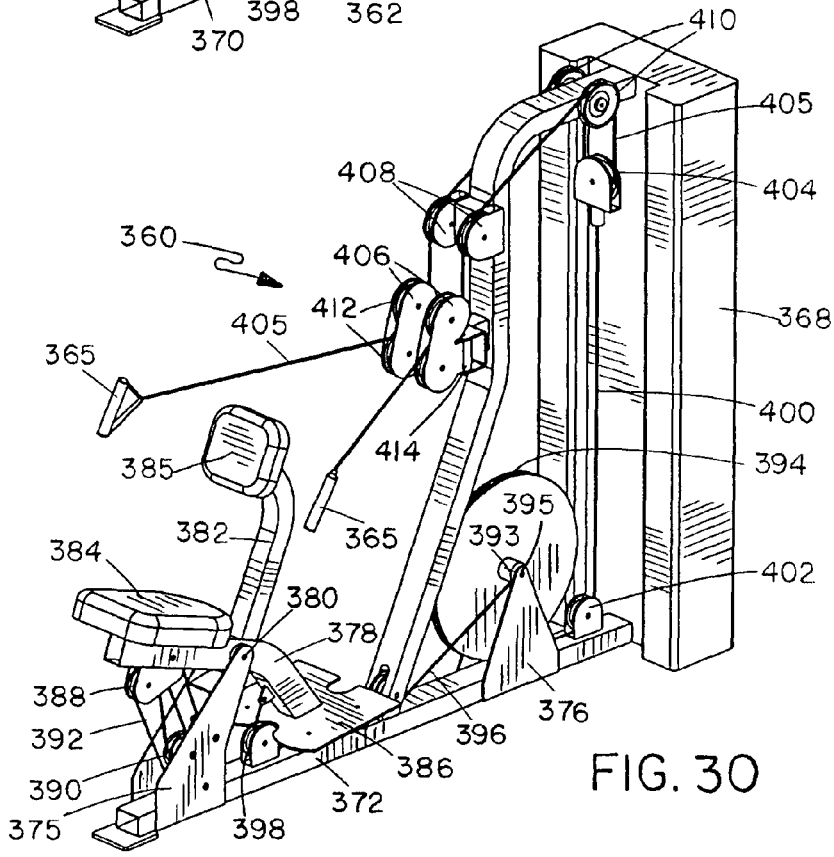
FIG. 30 is a front perspective view similar to FIG. 31, illustrating the machine in an exercise ending position.
Figure 31:
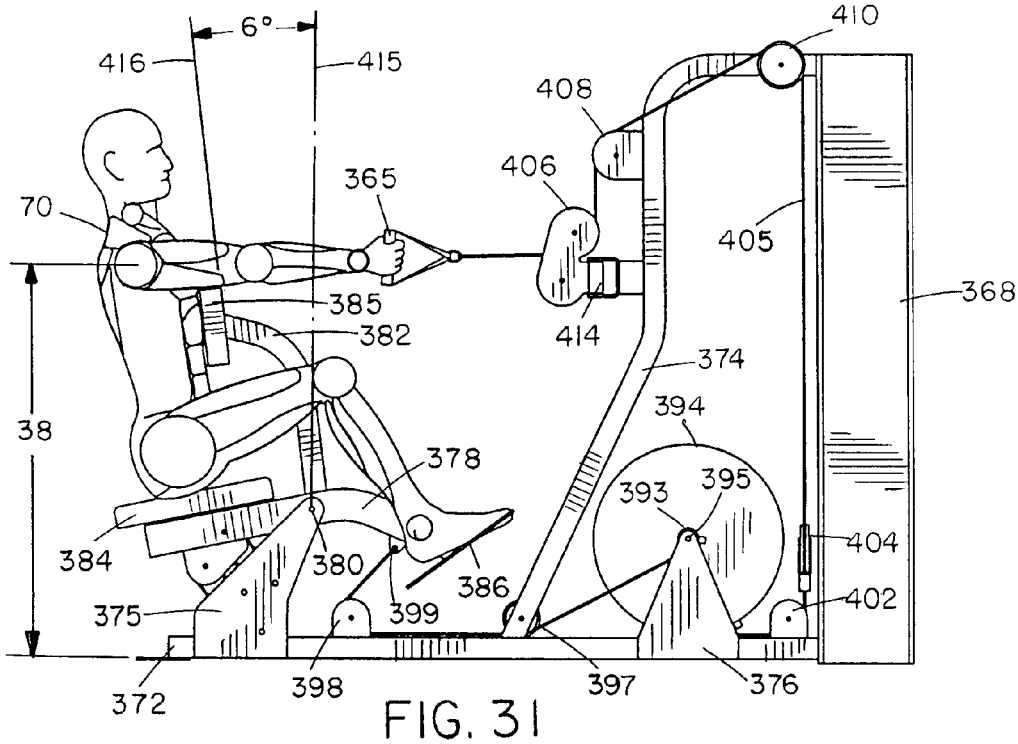
FIG. 31 is a side elevation view of the machine of FIGS. 29 and 30, with a user seated on the machine in the start position adopted at the beginning of the rear deltoid exercise.
Figure 32:
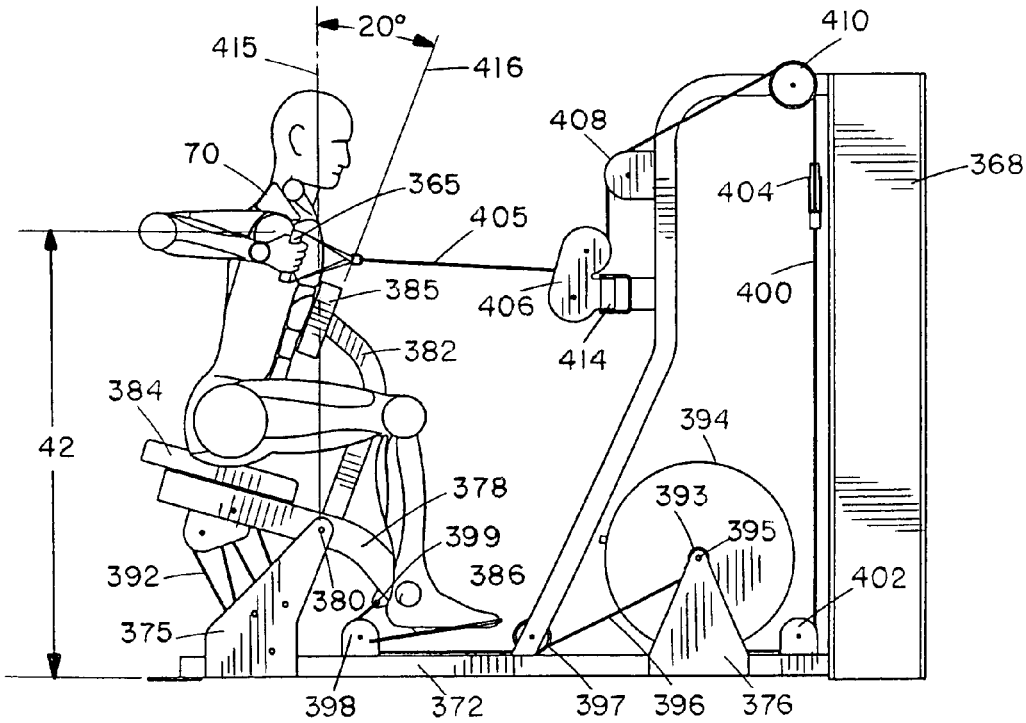
FIG. 32 is a side elevation view similar to FIG. 31, illustrating the user and machine in the end position of the exercise.
Figure 33:
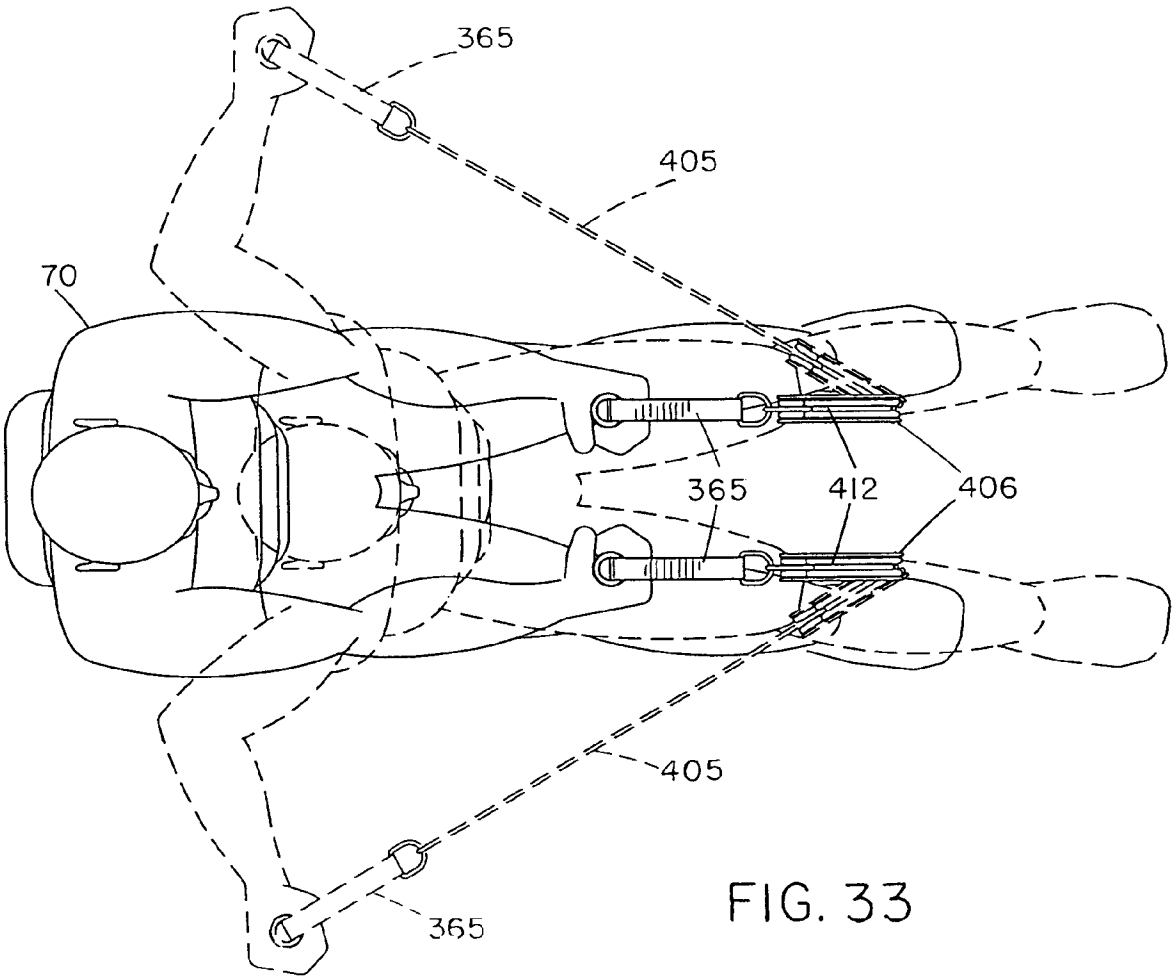
FIG. 33 is a top plan view of part of the user engaging handle part of the machine of FIGS. 29 to 32, with a seated user engaging the handles, illustrating the exercise start and end positions.

FIGS. 29 to 33 illustrate a rear deltoid exercise machine 360 according to another embodiment of the invention. This machine performs rear deltoid exercises similar to the free standing rear deltoid exercise illustrated in FIGS. 40*a* and 40*b*. FIG. 29 illustrates the machine in a start position while FIG. 30 illustrates the machine in an end position for the exercise. FIGS. 31 to 33 illustrate a user 70 performing a rear deltoid exercise on the machine 360.

The machine 360 has a main frame 362, a user support frame 364 pivotally mounted on the main frame, user engaging handles 365 linked to the user support frame via a first cable and pulley assembly 366, and an exercise resistance comprising a weight stack in housing 368 also linked to the user support frame via a second cable and pulley assembly 370. The main frame 362 comprises a horizontal base section 372, an upright section 374, user support pivot mount plates 375 extending upwardly at the rear end of the base section, and a pair of cam pivot mounting plates 376 extending upwardly from the base section between the upright section 374 and the weight stack housing 368.

The user support frame 364 is generally T-shaped, with a base 378 pivotally mounted between the upper ends of the pivot mount plates via pivot pin 380, and an upright post 382 which curves rearward at its upper end. A user support seat pad 384 is mounted on the rear part of the base, while a chest support pad 385 is mounted at the upper end of post 382. A foot support or footplate 386 is secured to the forward end of the base 378. The rear part of the base 378 is linked to the weight stack via the second cable and pulley assembly 370, which comprises a set of pulleys 388 mounted on the undersurface of base 378, a set of pulleys 390 mounted between the pivot mounting plates 375, a cable 392 extending from an anchor back and forth over the two sets of pulleys, and then running through the base 372 into the weight stack housing where it extends over further pulleys (not visible in the drawings) before linking in any conventional manner with the weight stack.

The forward end of the user support base is linked to the user engaging handles via the first cable and pulley assembly 366. The cable and pulley assembly includes first and second cams 393,394 of different diameter mounted on a pivot shaft 395 rotatably mounted between the upper ends of cam plates 376. The forward end of the user support base 378 is linked to the first, smaller cam 393 by a cable 396 extending from the cam around a pulley 397 at the lower end of upright 374, around a second pulley 398 on the frame base beneath the user support base, and tied off at anchor 399 on the underside of the base 378 close to the footplate 386.

A second cable 400 extends from the second, larger cam 394 around a fixed pulley 402 at the forward end of base 372 and is anchored to the housing of a floating pulley 404. A third cable 405 has opposite ends secured to the respective handles 365, and extends from one handle around one of a pair of swivel pulley assemblies 406 mounted on upright 374, around one of a pair of fixed, side-by-side pulleys 408 on the upright above the swivel pulley assemblies 406, then around one of a pair of parallel pulleys 410 on opposite sides of an upper, generally horizontal portion of the upright 374, and then downwardly around the floating pulley 404. From the pulley 404, cable 405 extends back up around the second one of the pulleys 410, around the second one of the pulleys 408, and is then reeved between the two pulleys 412 in the second one of the swivel pulley assemblies, before connecting to the second handle 365. With this arrangement, rearward movement of one or both handles will pull up the floating pulley 404, rotating the cams 393,394 to pull the cable 396 and rotate the user support upwardly about pivot 380. The swivel mounts 414 of the two swivel pulley assemblies 406 allow the assemblies to pivot in and out as indicated in FIG. 33 as the user moves their hands outwardly in the exercise movement, from a location in front of their chest to a position outwardly from each shoulder, as indicated in solid and dotted lines in the drawing.

In order to perform a rear deltoid exercise, the user 70 first sits on the user support in the position of FIG. 31 and the solid line position of FIG. 33, placing their feet on the footplate 386, their chest against the chest pad 385, and grabs the handles 365 with their arms straight in front of their body, slightly bent, and their hands close together, as indicated in FIG. 31 and in solid lines in FIG. 33. At the start of the exercise, the user is in a slightly reclined orientation at an angle of around 6 degrees to the gravitational centerline 415 or vertical centerline of the user support pivot 380, as indicated in FIG. 31, where the second dotted line 416 indicates the orientation of the chest pad 385 or front of the user's chest. This is similar to the rear deltoid starting position for a free standing exercise, as illustrated schematically in FIG. 40*a*.

From the position illustrated in FIG. 31, the user pulls the handles or hand grips 365 rearward and outward, into the position illustrated in FIG. 32 and in dotted outline in FIG. 33. As noted above, this also pulls the user support upwardly against the exercise resistance, with the chest pad and user upper body ending up in a forward lean of around 20 degrees from the vertical. The user's arms finish in a bent position with their hands positioned out to the sides, slightly below and forward of their shoulders, similar to the end position for the free standing rear deltoid exercise illustrated in FIG. 40*b*.

The user is in three different positions throughout the exercise, starting in a recline or decline position, traveling through a straight, upright position, and ending in a forward incline position. At the same time, there is a change in elevation of the user's shoulders between the start and finish position, which amounts to about a four inch change. Additionally, the user can determine the travel path of the user engaging handles or grips. These factors together provide an enhanced workout by involving a greater number of muscles than a rear deltoid press performed in only one position, thereby combining multiple exercises into one.

The gravitational centerline or vertical centerline 415 of the user support pivot runs through the exerciser's thigh, just behind the knee in the start position and ending at mid thigh in the finish position. There is a balanced distribution of weight on each side of the centerline 415 both at the start and end position, minimizing the effect that the weight of the exerciser and user support has on the exercise resistance. The amount of weight positioned on each side of centerline 415 varies only slightly from the start to the finish position. The combined weight of the user and user support has little effect on the amount of starting resistance because a substantially equal amount of weight is balanced rearward of the user support pivot. By the same token, because only a small portion of the user passes through the gravitational centerline during the exercise, there is no appreciable drop-off in resistance felt by the user.

In the exercise machine of FIGS. 29 to 33, the rigid exercise arm of the previous embodiments is replaced by handles attached to a flexible line, to provide a unilateral, three dimensional user defined exercise motion. The machine is designed to mimic the natural elliptical movement of the corresponding free dumbbell exercise, but is able to combine the effectiveness of multiple exercises by rotating the user from incline to flat to reclined positions throughout the exercise. This is also true of the pec fly machine of FIGS. 25 to 28.

Although each of the exercise machines described above is a single exercise machine, it will be understood that any of them may be incorporated as one of the exercise stations in a multi-station exercise machine. All of the exercise machines described above provide safer exercise motions because the user is properly braced with a primary and secondary support while positioned on a moving user support. They do not have to purposely lean forward or into any other position and adjust their body position while balancing on a moving user support. In each case, the multiple user support pads provide secure and safe positioning, placing the user in the proper exercise alignment from start to finish, without any adjustment required by the user. The seat and back pad travel together in fixed alignment to keep the user in the same position throughout the exercise motion so that the user does not have to worry about balancing on a moving platform or pad.

In each case, the user support is positioned relatively low to the ground in the start and end position, making the machines quicker, easier, and safer to enter and exit. The user does not have to climb up or down in order to get into, or out of, the exercise position. The low profile also makes the machines more economical to produce and less intimidating to the user. The combined exercise arm and user support movement produces an automatic and continuous self-aligning exercise motion that allows enhanced hand, wrist and foot positioning versus free weight and free bar exercises or prior art machines for performing equivalents of such exercises.

The machines described above all have a user support pivot which is positioned so that a portion of the combined weight of the user and user support is positioned on each side of the gravitational centerline of the pivot in both the start and finish positions. This provides counterbalancing to prevent resistance drop-off and offset the weight of the exercise arm, with limited effect on the exercise resistance felt by the user and no excessive starting resistance. In all cases, the user support pivot is positioned directly under the primary user support seat pad or back pad.

Each of the above embodiments has a primary support, generally a seat or backpad, and a secondary support, which may be a back pad, shoulder pad, thigh hold down pads, chest pad, or the like. The primary and secondary supports remain in fixed relative positive throughout the exercise. The choice of primary and secondary support depends on the type of exercise. For example, in the first five embodiments above (the rigid arm pull down machine, the seated dip machine, the shoulder press and chest press machines, and the mid row machine), as well as the pec fly of the seventh embodiment, the primary support is a seat pad while the secondary support is the back pad. Each of these embodiments also has an additional stabilization means comprising a footplate or foot plates on which the user can rest their feet throughout the exercise. In the lying leg press of FIGS. 21 to 24, the primary support is the back pad and the secondary support is the head rest/shoulder pads, while additional stabilization is provided by the hand grips. In the rear deltoid exercise machine of FIGS. 29 to 32, the primary support is the seat pad while the secondary support is the chest pad. Additional stabilization is provided by the foot plate. In each case, the foot plate may be mounted on the moving user support or on the frame, depending on the amount of movement of the user support through the exercise. In most of the embodiments, each of the user supports remains in a fixed position relative to the other supports throughout the exercise movement, supporting the user's body in a stable and fixed position for added stability and comfort. This also reduces the risk of injury due to improper movements. In the embodiment of FIGS. 5 to 8, the foot support is fixed to the frame but the movement of the user support is so small that the user's feet are supported comfortably throughout the exercise.

In each of the above embodiments, the user engagement means, which comprises an exercise arm with handles or a foot plate, or handles attached to a flexible line, is linked to the user support so that movement of the user engagement means produces movement in the user support. This may be a solid link pivoted to both the user engagement means and user support, as in the first and fourth embodiments, which may be adjustable in length as in the first embodiment, or may be pivoted at one end to a sliding member on the user support, as in the third embodiment of FIGS. 9 to 12. Alternatively, the linkage may comprise gear toothed cams, as in the second embodiment above. Another alternative linkage is the sliding wedge assembly of the mid row machine of FIGS. 17 to 20. In another alternative, as in FIGS. 21 to 24, the exercise arm is pivoted directly to the user support and a connecting link pivotally links the exercise arm to the frame such that rotational movement of the arm results in rotational movement of the user support. In the alternative of FIGS. 25 to 28, the linkage comprises a cable and pulley assembly between the seat and user engagement means. Another example of a flexible linkage between the user engagement means and the user support is illustrated in the last embodiment of FIGS. 29 to 33.

It will be understood that any suitable connecting link may be used to link movement of the user engagement means to movement of the user support, either solid or flexible links, the connecting links could be made adjustable, and may be designed to push or pull, rotate or slide, and still force rotation of the user support. The user support and exercise arm can be designed to travel in the same or opposite directions, and the exercise arm and connecting link may travel in the same or opposite directions. Different user engaging handles may be used, providing rigid or flexible, fixed or self-aligning aligning, two dimensional or three dimensional hand movement, without affecting the overall function of the machines. The exercise resistance may be a weight stack linked to part of the apparatus by a cable and pulley arrangement, or may be weight plates mounted on pegs as in FIGS. 13 to 16. Any other type of resistance known in the art may alternatively be used, such as hydraulic, pneumatic, electro-magnetic, or elastic bands, in place of the weight stack or weight plates. The resistance may be associated with any of the moving parts, i.e. the user support, the exercise arm, or the connecting link.

It will be understood that different types and forms of components may be used in place of those shown in the drawings without affecting the scope of the invention. For example, cables could be replaced with belts, ropes, chains or any type of elongate, flexible member, and pulleys may be replaced by sprockets. The seat pad, back pad, and/or foot plate could be mounted to adjust in position or angle. The exercise arms could be one piece (dependent) or two piece for independent arm movement, uni-directional or bi-directional, may be rigid or flexible, may be mounted on the user support, main frame, or connecting link, and the exercise arm movement may be rotational or linear.

In the exercise machine of this invention, operation of the user engagement means, whether a rigid exercise arm, flexible member, or foot plate, results in a rocking movement of the user support. Due to the position of the user support pivot, the movement of the user and user support has only a small effect on the exercise resistance felt by the user, and there is no high resistance to be overcome in starting the exercise, or large resistance drop-off. The rocking movement of the user support makes the exercise enjoyable to perform. Repetitious exercise movement can be tedious and boring. By adding motion to the user support, without any large increase or change in resistance felt during the exercise, performing the exercise is more enjoyable and the user's interest in their workout increases. This is a benefit both to the individual exerciser, who will exercise more regularly, and the fitness facility, where retention of members is a primary objective.

Although some exemplary embodiments of the invention have been described above by way of example only, it will be understood by those skilled in the field that modifications may be made to the disclosed embodiments without departing from the scope of the invention, which is defined by the appended claims.

We claim:

1. An exercise machine, comprising:

a main frame;

a user support frame pivotally mounted relative to the main frame for rotation about a user support pivot axis, the user support pivot axis defining a vertical, gravitational center line and a horizontal line extending through the user support pivot axis transverse to the vertical gravitational center line, the user support frame comprising one moving part of the machine which moves between a start position and an end position during an exercise movement;

the user support frame having at least a primary support and a secondary support for supporting spaced positions on a user's body throughout an exercise movement, the secondary support being fixed at a predetermined angular orientation relative to the primary support, the primary support supporting the majority of a user's weight in the start position of the support frame, and the secondary support remaining in the same predetermined angular orientation relative to the primary support throughout an exercise movement, whereby the primary and secondary supports travel together at the predetermined angular orientation relative to one another throughout the exercise movement;

the horizontal line which extends through the user support pivot axis being located below the user's hips in at least one of the start and end positions of the exercise movement;

a user engagement device movably mounted on one of the frames for engagement by the user in performing exercises, the user engagement device comprising a second moving part of the machine;

a connecting link linking movement of the user engagement device to movement of the user support frame, the connecting link comprising a third moving part of the machine; and a load for resisting movement of at least one of the moving parts of the machine;

the user support pivot axis being positioned such that portions of the combined weight of the user and user support frame are distributed on each side of the gravitational center line of the user support pivot axis in both the start and end position and only a portion of the combined weight passes through the gravitational center line during the exercise movement.

2. The machine as claimed in claim 1, wherein the primary support comprises a seat pad.

3. The machine as claimed in claim 2, wherein the secondary support comprises a back pad.

4. The machine as claimed in claim 1, including an additional user support for supporting a different part of the user's body from the primary support and secondary support.

5. The machine as claimed in claim 4, wherein the additional user support is mounted on the user support frame.

6. The machine as claimed in claim 4, wherein the additional user support comprises a foot support for the user's feet.

7. The machine as claimed in claim 1, wherein the user support frame defines an initial position for the user's body when supported on the frame in the start position of the exercise, and a finish position for the user's body in the end position of the exercise, the gravitational center line extending through a central portion of the user's body in at least one of said initial and finish positions.

8. The machine as claimed in claim 7, wherein the gravitational center line of the user support pivot axis extends through the user's hips in at least one of said user positions.

9. An exercise machine, comprising:

a main frame;

a user support frame pivotally mounted relative to the main frame for rotation about a user support pivot axis, the user support pivot axis defining a vertical, gravitational center line, the user support frame comprising one moving part of the machine;

the user support frame having at least a primary support and a secondary support for supporting spaced positions on a user's body throughout an exercise movement, the primary support supporting the majority of a user's weight in a start position of the support frame, the user support frame having a base member and an upright extending generally upwardly at an angle less than 180 degrees to the base member and which is fixed and not movable relative to the base member, the primary user support comprising a pad mounted on the base member;

a user engagement device movably mounted on one of the frames for engagement by the user in performing exercises, the user engagement device comprising a second moving part of the machine;

a connecting link linking movement of the user engagement device to movement of the user support frame, the connecting link comprising a third moving part of the machine; and a load for resisting movement of at least one of the moving parts of the machine;

the user support pivot axis lying on a horizontal line which is located below the entire user engaging part of the primary user support in at least one of the exercise start and end positions, and being positioned such that portions of the combined weight of the user and user support frame are distributed on each side of the gravitational center line of the user support pivot axis in both the start and end position and only a portion of the combined weight passes through the gravitational center line during the exercise movement.

10. The machine as claimed in claim 9, wherein the user support pivot axis is located approximately at a junction between the base member and upright of the user support frame.

11. The machine as claimed in claim 1, wherein the user engagement device is movably mounted on the main frame.

12. The machine as claimed in claim 1, wherein the user engagement device comprises at least one rigid exercise arm.

13. The machine as claimed in claim 1, wherein the connecting link is a rigid link.

14. The machine as claimed in claim 13, wherein the connecting link has a first end pivoted to said user engagement device and a second end pivoted to said user support frame.

15. The machine as claimed in claim 1, wherein the user engagement device is adjustable.

16. An exercise machine, comprising:

a main frame having a floor-engaging portion;

a user support frame pivotally mounted relative to the main frame for rotation about a user support pivot axis at a location spaced above the floor-engaging portion, the support frame being designed for supporting the body of a user in a predetermined exercise position, the pivot axis defining a vertical, gravitational center line of the pivotal movement, the user support frame comprising one moving part of the machine;

the user support frame having at least a primary user support and a secondary user support for supporting different parts of a user's body during an exercise, the secondary user support being at a predetermined angular orientation of less than 180 degrees to the primary user support, the primary and secondary user support together supporting the majority of the user's body weight during the exercise and traveling together with the secondary user support fixed at the predetermined angular orientation relative to the primary user support throughout the exercise movement;

an exercise arm movably mounted on one of the frames for engagement by the user in performing exercises, the exercise arm having at least one user engaging portion, and comprising a second moving part of the machine;

a connecting link linking movement of the exercise arm to movement of the primary and secondary user support, the connecting link comprising a third moving part of the machine; and a load for resisting movement of at least one of the moving parts of the machine, whereby movement of the user engagement device in an exercise movement simultaneously moves the user support frame and user between a start position and an end position;

the user support pivot axis lying on a horizontal plane located below the user's hips during at least part of an exercise movement.

17. The machine as claimed in claim 16, including an additional user support mounted on the user support frame and moving with the user support frame.

18. The machine as claimed in claim 16, wherein the additional user support comprises at least one foot support plate.

19. The machine as claimed in claim 16, wherein the gravitational center line passes through a central portion of the user's body in at least one of the start and end positions.

20. The machine as claimed in claim 19, wherein the gravitational center line passes through the user's hips in at least one of the start and end positions.

21. An exercise machine, comprising:

a main frame having a floor-engaging portion;

a user support frame pivotally mounted on the main frame for rotation about a user support pivot axis at a location spaced above the floor-engaging portion, the support frame being designed for supporting the body of a user in a predetermined exercise position, the pivot axis defining a vertical, gravitational center line of the pivotal movement and a horizontal line extending through the user support pivot axis transverse to the vertical gravitational center line, the user support frame comprising one moving part of the machine;

the user support frame having at least a primary user support and a secondary user support for supporting different parts of a user's body during an exercise, the secondary support being fixed at a predetermined angular orientation relative to the primary support, the primary support supporting the majority of a user's weight in the start position of the support frame, and the secondary support remaining in the same predetermined angular orientation relative to the primary support throughout an exercise movement, whereby the primary and secondary supports travel together at the predetermined angular orientation relative to one another throughout the exercise movement;

an exercise arm movable relative to at least one of the frames and movably mounted on said at least one of the frames for engagement by the user in performing exercises, the exercise arm having at least one user engaging portion, and comprising a second moving part of the machine;

a connecting link linking movement of the exercise arm to movement of the entire user support frame, the connecting link comprising a third moving part of the machine;

a load for resisting movement of at least one of the moving parts of the machine, whereby movement of the user engagement device in an exercise movement simultaneously moves the user support frame and user between a start position and an end position;

the horizontal line which extends through the user support pivot axis being located below the user's hips in at least one of the start and end positions of the exercise movement; and the user support pivot axis being positioned such that portions of the combined weight of the user and user support frame are distributed on each side of the gravitational center line of the user support pivot axis in both the start and end position and a portion of the combined weight passes through the gravitational center line during the exercise movement.

22. An exercise machine, comprising:

a main frame;

a user support frame pivotally mounted relative to the main frame for rotation about a user support pivot axis, the user support pivot axis defining a vertical, gravitational center line, the user support frame comprising one moving part of the machine;

the user support frame having at least a primary support and a secondary support for supporting spaced positions on a user's body throughout an exercise movement, the primary support comprising a seat pad and the secondary support comprises a leg support which travels in the same direction as the primary support throughout an exercise movement;

a user engagement device movably mounted on one of the frames for engagement by the user in performing exercises, the user engagement device comprising a second moving part of the machine;

a connecting link linking movement of the user engagement device to movement of the user support frame, the connecting link comprising a third moving part of the machine; and a load for resisting movement of at least one of the moving parts of the machine; whereby movement of the user engagement device in an exercise movement simultaneously moves the user support frame between a start position and an end position, the user support pivot axis being positioned such that portions of the combined weight of the user and user support frame are distributed on each side of the gravitational center line of the user support pivot axis in both the start and end position and only a portion of the combined weight passes through the gravitational center line during the exercise movement.

23. The machine as claimed in claim 22, wherein the secondary support is a foot rest.

24. The machine as claimed in claim 1, wherein the user support pivot axis is located directly behind the primary user support.

25. The machine as claimed in claim 9, wherein the user support pivot axis is located on the upright of the user support frame.

26. The machine as claimed in claim 21, wherein the secondary user support comprises a leg support.

27. The machine as claimed in claim 1, wherein said user engagement device comprises two user engaging portions which engage the user's hands or the user's feet, whereby movement of the user support frame is selectively controlled by actuation of one or both user engaging portions.

* * * * *